US011280056B2

(12) United States Patent
Luptak et al.

(10) Patent No.: US 11,280,056 B2
(45) Date of Patent: Mar. 22, 2022

(54) MULTI-ORIENTED SEGMENTAL WALL BLOCKS, SOIL REINFORCING SYSTEM, AND METHODS

(71) Applicant: Tensar International Corporation, Alpharetta, GA (US)

(72) Inventors: Stephen A. Luptak, Alpharetta, GA (US); Aaron D. Smith, Alpharetta, GA (US); Andres F. Peralta, Alpharetta, GA (US); Willie Liew, Alpharetta, GA (US)

(73) Assignee: Tensar International Corporation, Alpharetta, GA (US)

( * ) Notice: Subject to any disclaimer, the term of this patent is extended or adjusted under 35 U.S.C. 154(b) by 0 days.

(21) Appl. No.: 16/871,262

(22) Filed: May 11, 2020

(65) Prior Publication Data

US 2020/0270836 A1 Aug. 27, 2020

Related U.S. Application Data

(62) Division of application No. 16/073,952, filed as application No. PCT/US2017/017002 on Feb. 8, 2017, now Pat. No. 10,648,147.

(Continued)

(51) Int. Cl.
*E02D 17/20* (2006.01)
*E02D 29/02* (2006.01)

(Continued)

(52) U.S. Cl.
CPC ..... *E02D 17/20* (2013.01); *E02D 17/205* (2013.01); *E02D 29/02* (2013.01); *E02D 29/025* (2013.01);

(Continued)

(58) Field of Classification Search
CPC . E02D 29/025; E02D 29/0241; E02D 17/205; E02D 29/0225; E02D 29/02;

(Continued)

(56) References Cited

U.S. PATENT DOCUMENTS 5,010,707 A * 4/1991 Nelson ..... E02D 29/025 52/605
5,480,267 A 1/1996 Hagenah (Continued)

FOREIGN PATENT DOCUMENTS

WO WO-2005009707 A1 * 2/2005 ..... E02D 29/025

OTHER PUBLICATIONS

International Search Report and Written Opinion issued in counterpart PCT Application No. PCT/US2017/017002 dated Jun. 15, 2017 (eighteen (18) pages).

*Primary Examiner* — Carib A Oquendo
(74) *Attorney, Agent, or Firm* — Nexsen Pruet, PLLC; E. Eric Mills; Todd A. Serbin

(57) ABSTRACT

Multi-oriented segmental wall blocks, soil reinforcing system, and methods related thereto are disclosed. The wall block may be a concrete masonry block used for constructing retaining walls. The wall block may include a front face; a rear cavity opposing the front 5 face and formed by an inner rear face, an outer rear face on three sides of the inner rear face and spaced apart therefrom, and a shelf defined therein by the inner rear face and the outer rear face; a troughed top face residing between the front face and the outer rear face; a flat bottom face opposing the troughed top face; a first side face residing between the front face and the outer rear face, and between the troughed top face and the flat bottom face; a second side face opposing the first side face; a trough running along the length of the troughed top face.

27 Claims, 35 Drawing Sheets

Related U.S. Application Data

(60) Provisional application No. 62/292,441, filed on Feb. 8, 2016.

(51) Int. Cl.
*E04C 1/39* (2006.01)
*E04B 2/02* (2006.01)

(52) U.S. Cl.
CPC ..... *E04B 2/02* (2013.01); *E04C 1/395* (2013.01); *E02D 29/0241* (2013.01)

(58) Field of Classification Search
CPC ..... E02D 17/20; E02D 29/0266; E02D 2600/20; E04C 1/395; E04B 2002/0269; E04B 2/08
See application file for complete search history.

(56) References Cited

U.S. PATENT DOCUMENTS

| | | | | |
|---|---|---|---|---|
| 5,484,235 | A | 1/1996 | Hilfiker et al. | |
| 5,709,062 | A | 1/1998 | Woolford | |
| 6,062,772 | A | 5/2000 | Perkins | |
| 6,082,933 | A * | 7/2000 | Maguire | E02D 29/025 405/286 |
| 6,715,965 | B2 * | 4/2004 | Manthei | E02D 29/025 405/262 |
| 2002/0030303 | A1 | 3/2002 | Manthei et al. | |
| 2005/0279046 | A1 | 12/2005 | Gravier | |
| 2008/0244995 | A1 * | 10/2008 | Kemp | E02D 29/025 52/169.4 |
| 2009/0142145 | A1 | 6/2009 | Martin | |
| 2011/0107707 | A1 | 5/2011 | Macdonald et al. | |
| 2012/0233952 | A1 * | 9/2012 | Hammer | E04C 1/395 52/588.1 |
| 2013/0025223 | A1 | 1/2013 | Woolbright | |
| 2018/0100283 | A1 * | 4/2018 | Lonero | E04H 17/1404 |

* cited by examiner

MULTI-ORIENTED SEGMENTAL WALL BLOCKS, SOIL REINFORCING SYSTEM, AND METHODS

CROSS REFERENCE TO RELATED APPLICATIONS

This application is a divisional application of U.S. application Ser. No. 16/073,952 filed Jul. 30, 2018, which is a 35 U.S.C. § 371 U.S. national phase entry of International Application No. PCT/US2017/017002 having an international filing date of Feb. 8, 2017, which claims the benefit of U.S. Provisional Application No. 62/292,441 filed Feb. 8, 2016, each of which is incorporated herein by reference in its entirety.

TECHNICAL FIELD

The presently disclosed subject matter relates generally to the retention of earthen formations and the field of retaining walls and more particularly to multi-oriented segmental wall blocks, a soil reinforcing system, and methods related thereto.

BACKGROUND

Retaining walls are commonly used for architectural and site development applications and such soil reinforced earthen works have now become a recognized civil engineering structure useful in the retention of hillsides, right of way embankments, and the like. The wall facing elements, which typically consist of masonry blocks, concrete blocks, concrete panels or welded wire forms, must withstand lateral pressures exerted by backfill soils. Reinforcement and stabilization of the soil backfill in mechanically stabilized earth applications is commonly provided using geosynthetic materials such as geogrids or geotextiles that are placed horizontally in the soil fill behind the wall face. The geosynthetic materials interlock with the soil and create a stable reinforced soil mass. The geosynthetic materials are connected to the wall face elements.

A preferred form of grid-like tie-back sheet material used to reinforce the soil behind a retaining wall structure, known as an integral geogrid, is commercially available from The Tensar Corporation of Alpharetta, Ga. ("Tensar") and is made by the process disclosed in U.S. Pat. No. 4,374,798 ("the '798 patent"). Integral geogrid tie-back sheet material may be uniaxially oriented according to the '798 patent to provide grid-like sheets including a plurality of elongated, parallel, molecularly oriented strands with transversely extending bars integrally connected thereto by less oriented or unoriented junctions, the strands, bars and junctions together defining a multiplicity of elongated openings. With biaxial (i.e., 2-dimensional) stretching, the bars may be oriented into elongated strands. While integral geogrids are preferred as reinforcing materials in the construction of retaining walls, other forms of tie-back sheet materials have been used in a similar manner.

The use of full height pre-cast concrete wall panels for wall-facing elements in a retaining wall is known such as is disclosed in U.S. Pat. Nos. 5,568,998 and 5,580,191. These types of systems typically require, during construction, that the panels be placed using a crane because they are very large, perhaps 5 feet (1.5 m) by 10 feet (3.0 m) or even larger and, as a result, are quite heavy such that they cannot be readily man-handled. To avoid such problems in the use of pre-cast wall panels, other types of retaining wall structures have been developed.

As one known example, retaining walls have been formed from modular wall blocks which are typically relatively small cementitious blocks as compared to cast wall panels. The assembly of modular wall blocks usually does not require heavy equipment. Such modular wall blocks can be handled by a single person and are used to form retaining wall structures by arranging a plurality of blocks in courses superimposed on each other, much like laying of brick or the like. Each block includes a body with a front face which forms the exterior surface of the formed retaining wall. Examples of such modular wall block systems are disclosed in U.S. Pat. Nos. 5,010,707; 5,522,682; 5,568,999; 5,823,709; 5,911,539; 5,934,838; and 6,287,054.

The use of welded wire (ww) facing units in the construction of retaining walls is also well known to reinforce earthen formations. U.S. Pat. Nos. 4,856,939; 6,595,726; and 8,197,159 disclose the construction of geogrid-reinforced earthen retaining walls incorporating welded wire facing units wherein portions of the face sections of the wire facing units include kinks or hooks which serve, inter alia, to retain the ends of geogrids, the remainder of the geogrids being designed to extend rearwardly into the fill to reinforce the wall. U.S. Pat. No. 4,904,124 also discloses the use of wire "baskets" that are designed to be filled with granular or rock material to define the forward or face of the wall, the elements of which are also reinforced with grid-like reinforcing sheet material to provide stability of the soil mass.

In the case of modular wall blocks that are typically used, several companies have begun utilizing blocks in a manner to create a more aesthetic wall pattern, such as the use of multiple sized blocks to create a segmented wall pattern. While providing end customers with more aesthetic pattern choices to choose from, this has typically lead to several disadvantages including the need for additional block manufacturing molds, increased time for delivery of varying sized blocks, and increased costs for the smaller block sections. As such, improvements in the art are desired to provide a retaining wall block system that utilizes one size and shaped block that can be multi-oriented to create random wall patterns while maintaining connection with the reinforcing sheet material as known in traditional block wall systems.

SUMMARY

Multi-oriented segmental wall blocks, soil reinforcing system, and methods related thereto are disclosed. The wall block may be a concrete masonry block used for constructing retaining walls.

In one embodiment, the wall block may include a front face; a rear cavity opposing the front face and formed by an inner rear face, an outer rear face on three sides of the inner rear face and spaced apart therefrom, and a shelf defined therein by the inner rear face and the outer rear face; a troughed top face residing between the front face and the outer rear face; a flat bottom face opposing the troughed top face; a first side face residing between the front face and the outer rear face, and between the troughed top face and the flat bottom face; a second side face opposing the first side face; a trough running along the length of the troughed top face and along the length of the first side face; a first groove disposed within the trough and running along the length of the troughed top face and along the length of the first side face; and a second groove running along the length of the second side face.

The front face of the segmental wall block can include an aesthetic feature disposed thereon or the front face can include one or more grooves or line features disposed thereon to create the appearance of the block face being comprised of multiple pieces.

The troughed top face of the segmental wall block can include one or more score lines to facilitate splitting or cutting of the wall block, or the troughed top face can include one or more imprints disposed thereon to assist in orienting of the block in use.

The segmental wall block can include at least one hollow open core extending from the troughed top face through to the flat bottom face.

The segmental wall block can include mechanical connectors, and a first mechanical connector can be disposed within the first groove and a second mechanical connector can be disposed within the second groove. The first groove can include a first width and the second groove can include a second width, the first width and second width are typically both measured from the front face to the outer rear face and are distinct. The first width can be less than the second width.

The mechanical connector can include a cross bar member and further include a first member including at least one serrated leg member extending from the cross bar member, and a second member including a peg member extending in an opposing direction from the cross bar member. In one embodiment, the first member of the mechanical connector is securable within the first groove and the second member of the mechanical connector is securable within the second groove.

A soil reinforcing system is also disclosed including a plurality of segmental wall blocks as described hereinabove along with a plurality of connectors that secure the plurality of segmental wall blocks together, each connector secured within the first groove or the second groove of each of the segmental wall blocks.

The system can further include a soil reinforcing element for reinforcement of the wall blocks in a soil mass and the soil reinforcing element can be a geogrid.

The plurality of connectors can further secure the soil reinforcing element to at least one of the plurality of segmental wall blocks.

In the system, the front face of each of the segmental wall blocks can include a height and a length, the height typically being a distance less than the length. The plurality of segmental wall blocks of the soil reinforcing system can be arranged in a standard running configuration or a pilaster configuration. A configuration of the plurality of segmental wall blocks of the soil reinforcing system can include vertically oriented blocks or can include vertically oriented blocks in combination with horizontally oriented blocks.

A method of reinforcing soil is also disclosed and includes the steps of providing a plurality of segmental wall blocks as described hereinabove; orienting a first wall block of the plurality of wall blocks in a desired orientation; providing a connector having a first member and a second member; engaging the first member of the connector in the first groove of the first wall block; orienting a second wall block of the plurality of wall blocks in a desired orientation adjacent to the first wall block; and engaging the second member of the connector in the second groove of the second wall block.

The method can further include the steps of providing a plurality of connectors each having a first member and a second member; engaging the first member of multiple connectors of the plurality of connectors in the first groove of the first wall block; and engaging the second member of multiple connectors of the plurality of connectors in the second groove of the second wall block.

The method can still further include the steps of providing a soil reinforcing element for reinforcement of the wall blocks in a soil mass; and connecting the soil reinforcing element with the plurality of wall blocks through use of the plurality of connectors wherein the second member of the connector engages in the second groove of the second wall blocks.

In an alternative embodiment, the wall block may include a front face; a rear face opposing the front face, the rear face having a tapered portion; a top face residing between the front face and the rear face; a bottom face opposing the top face and also residing between the front face and the rear face; a tapered end disposed adjacent to the tapered portion of the rear face; a flat end opposing the tapered end; a first groove disposed along the top face and the flat end; and a second groove disposed along the bottom face and the tapered end.

The front face of the segmental wall block can include an aesthetic feature disposed thereon.

The wall block can include a hollow core extending from the top face through the bottom face.

The wall block can include mechanical connectors and a first mechanical connector can be disposed within the first groove and a second mechanical connector can be disposed within the second groove.

The first groove can include a first width and the second groove can include a second width, the first width and second width are both typically measured from the front face to the rear face and are distinct. The first width can be greater than the second width.

The segmental wall block can further include a mechanical connector, the mechanical connector can include a first member having a first width and a second member having a second width, wherein the second width is distinct from the first width. In one embodiment, the first width of the first member corresponds to the first width of the first groove so that the first member of the mechanical connector is securable within the first groove of the segmental wall block. In another embodiment, the second width of the second member corresponds to the second width of the second groove so that the second member of the mechanical connector is securable within the second groove of the segmental wall block.

A soil reinforcing system and method of reinforcing soil are also disclosed in relation to the alternative embodiment and as described hereinabove and hereinbelow.

BRIEF DESCRIPTION OF THE DRAWINGS

Figure 1:
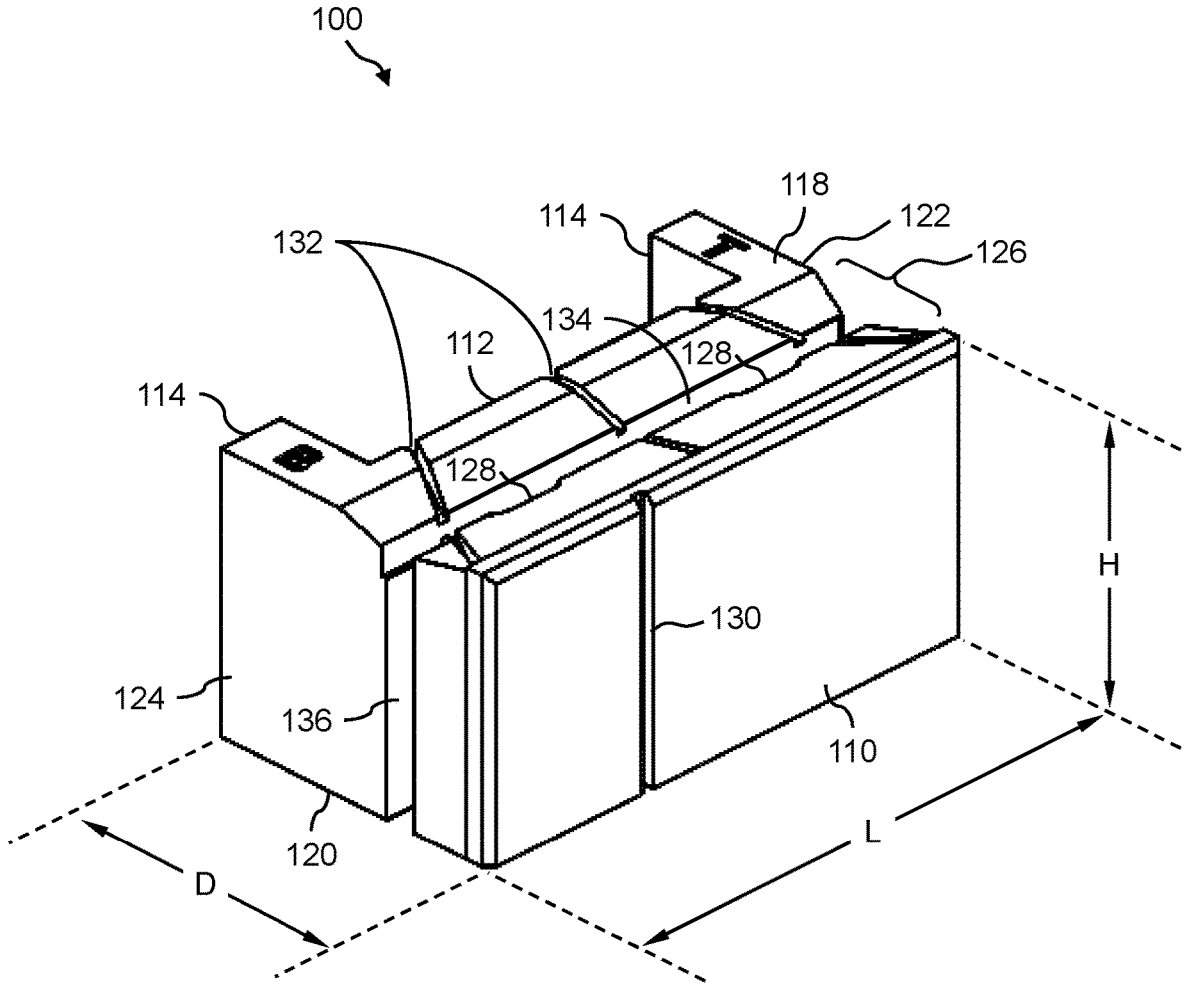
Figure 2:
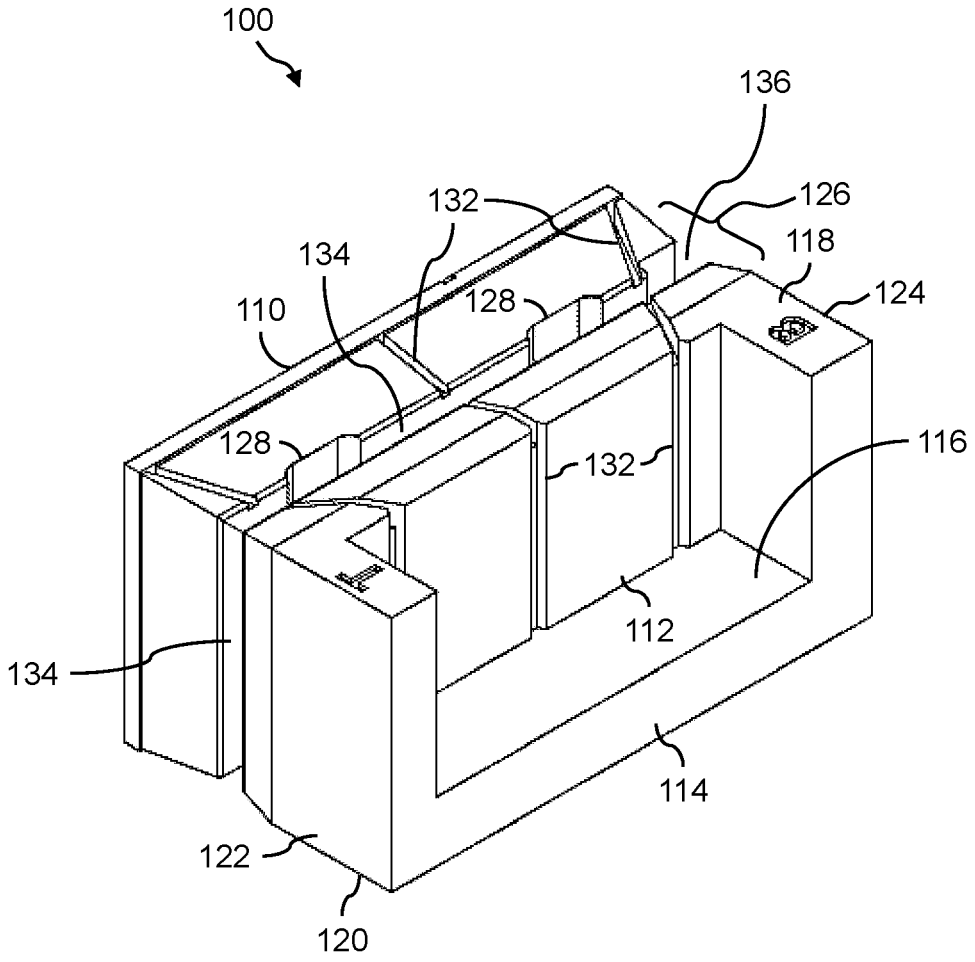
Figure 3:
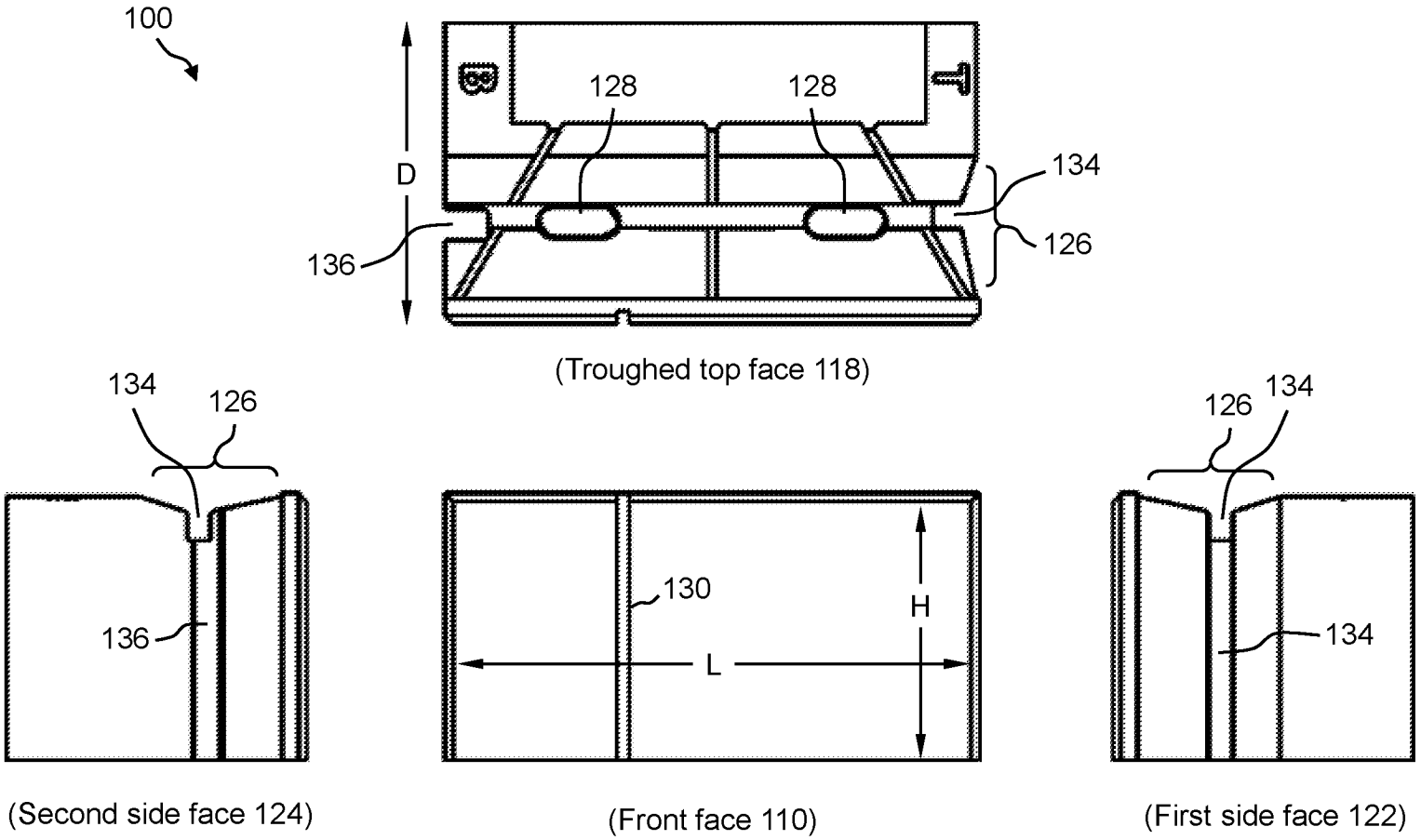
Figure 4:
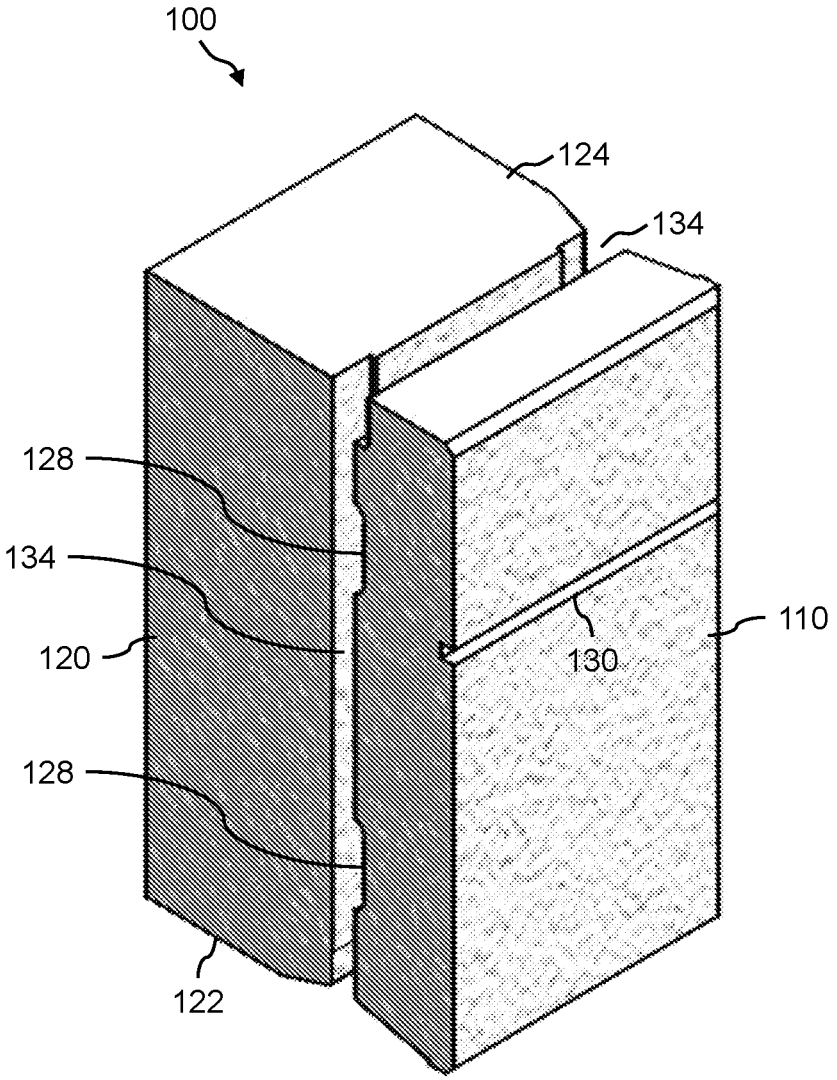
Figure 5:
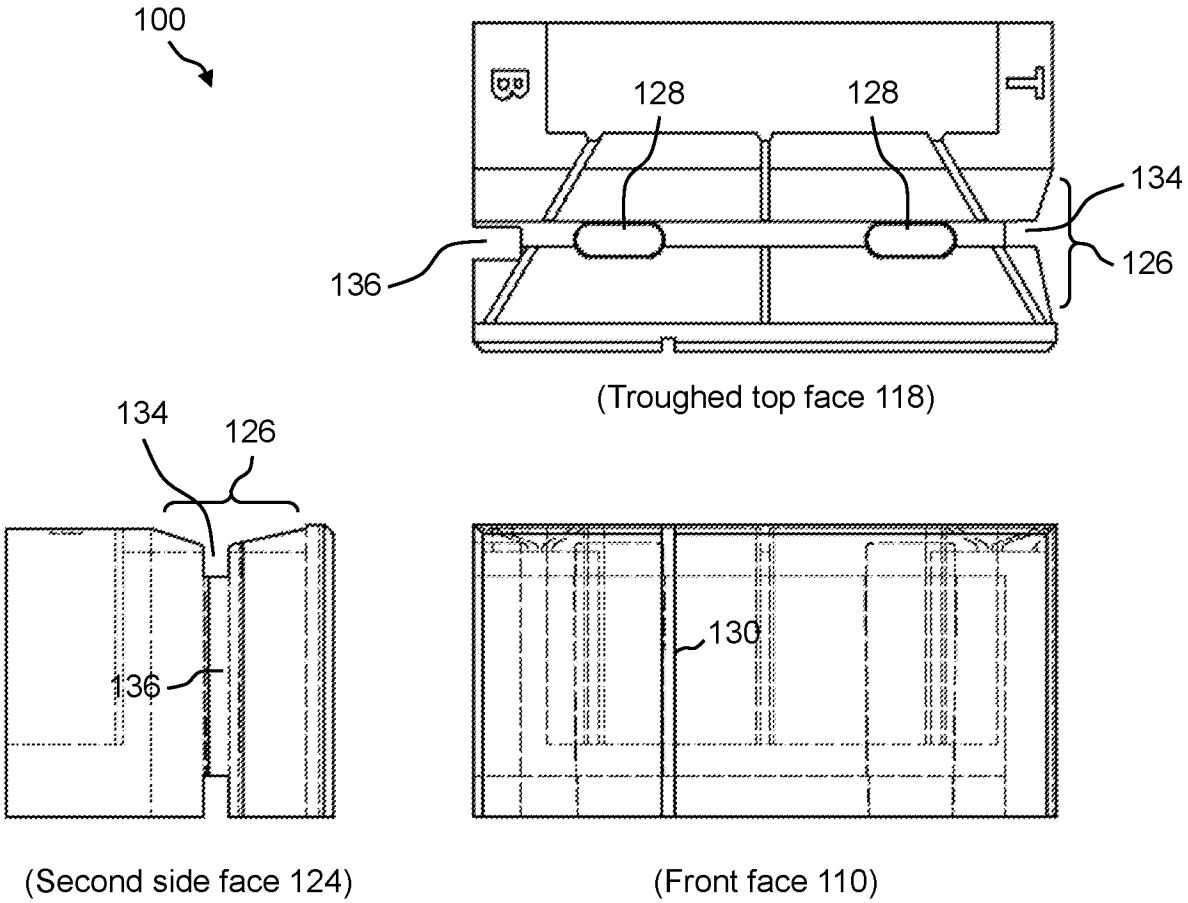
Figure 6:
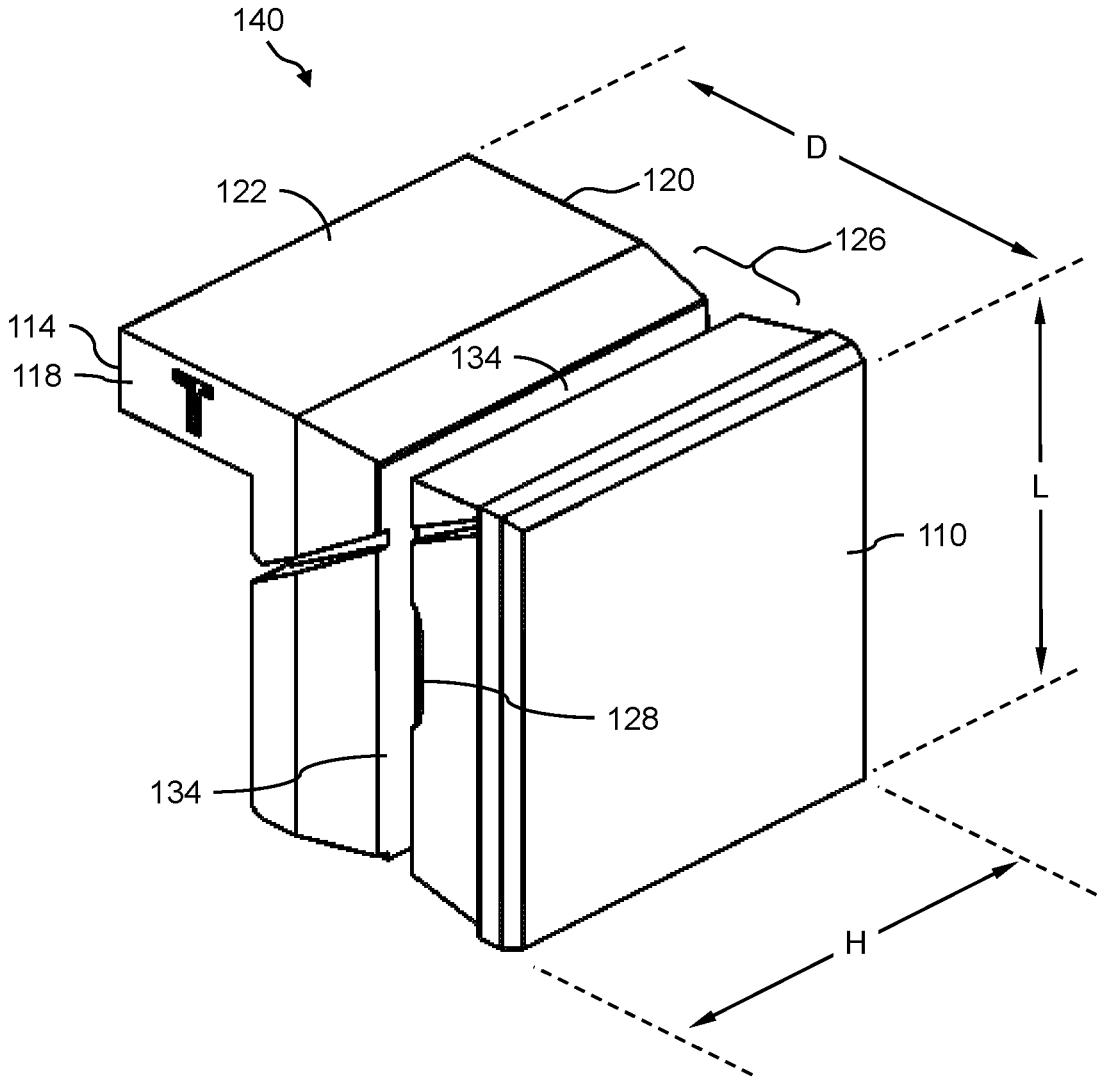
Figure 7:
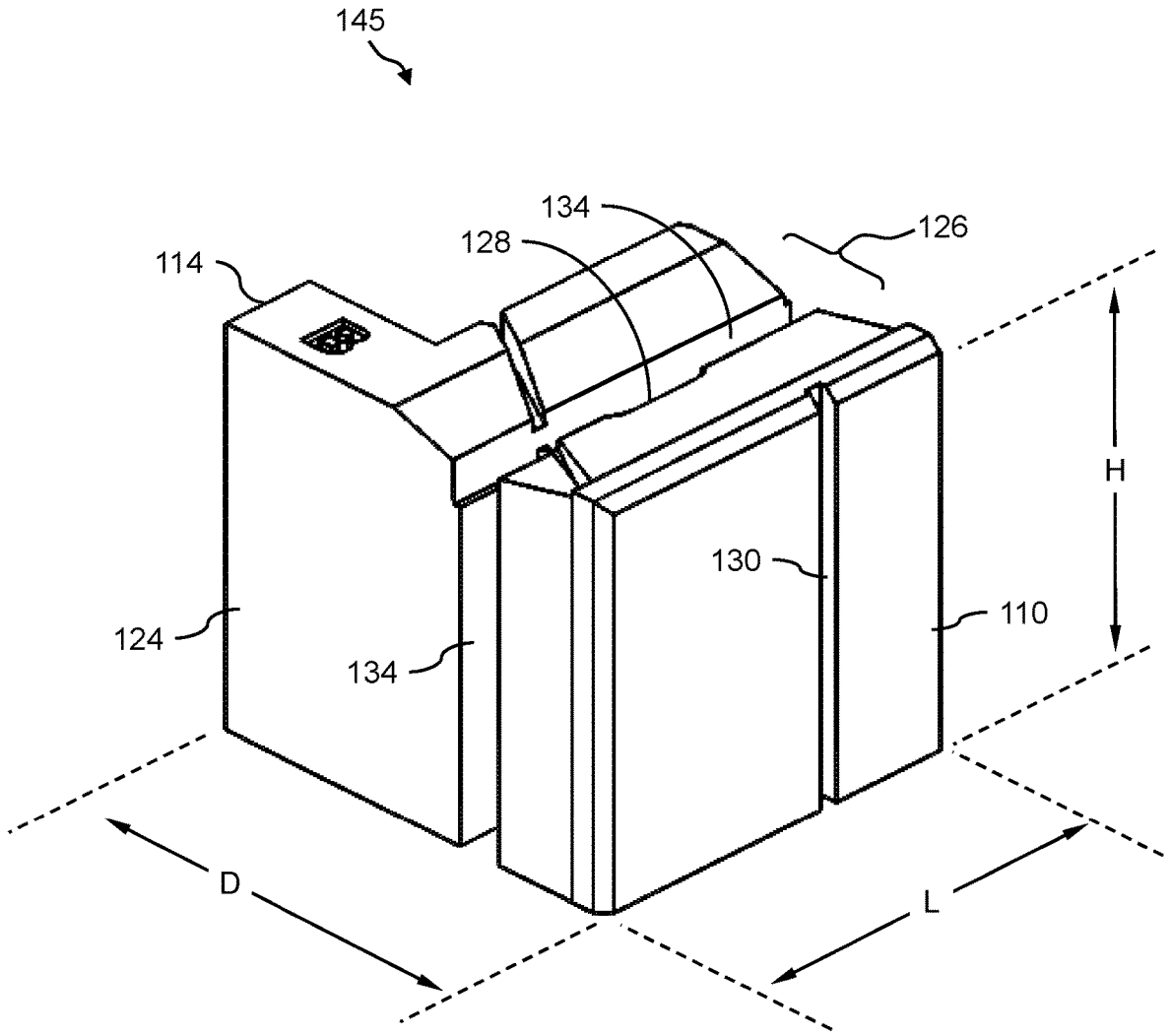
Figure 12A:
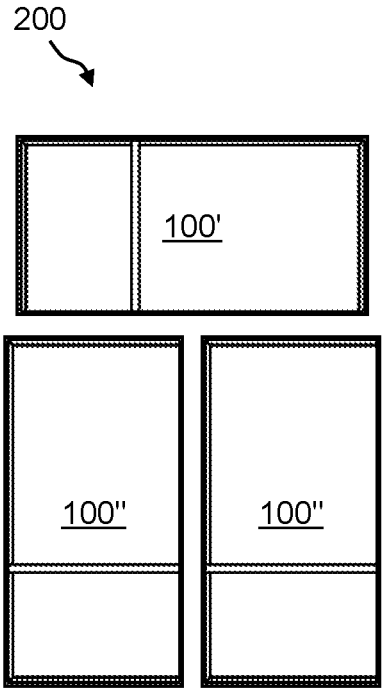
Figure 12B:
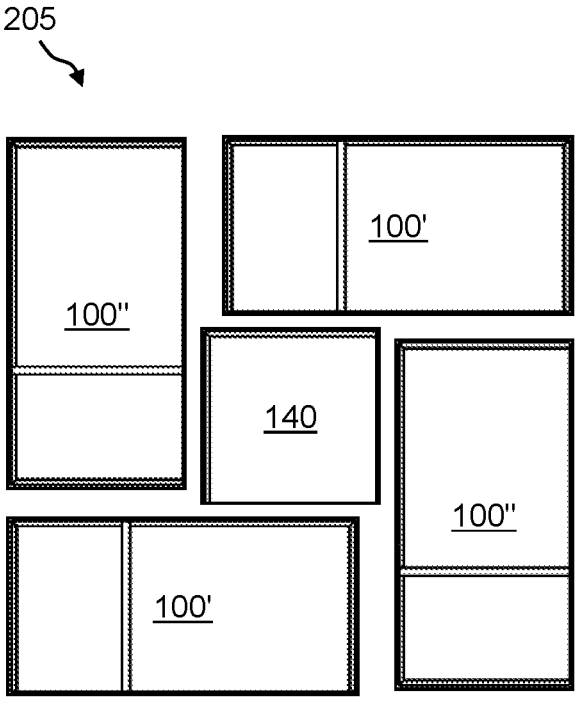
Figure 12C:
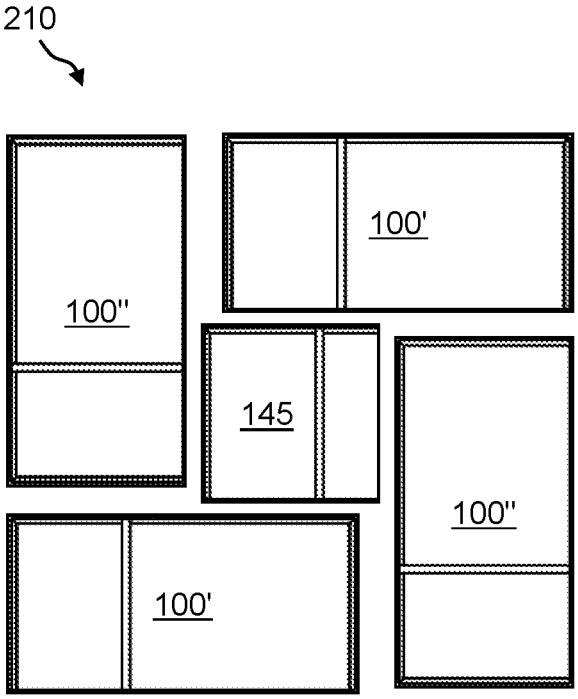
Figure 13:
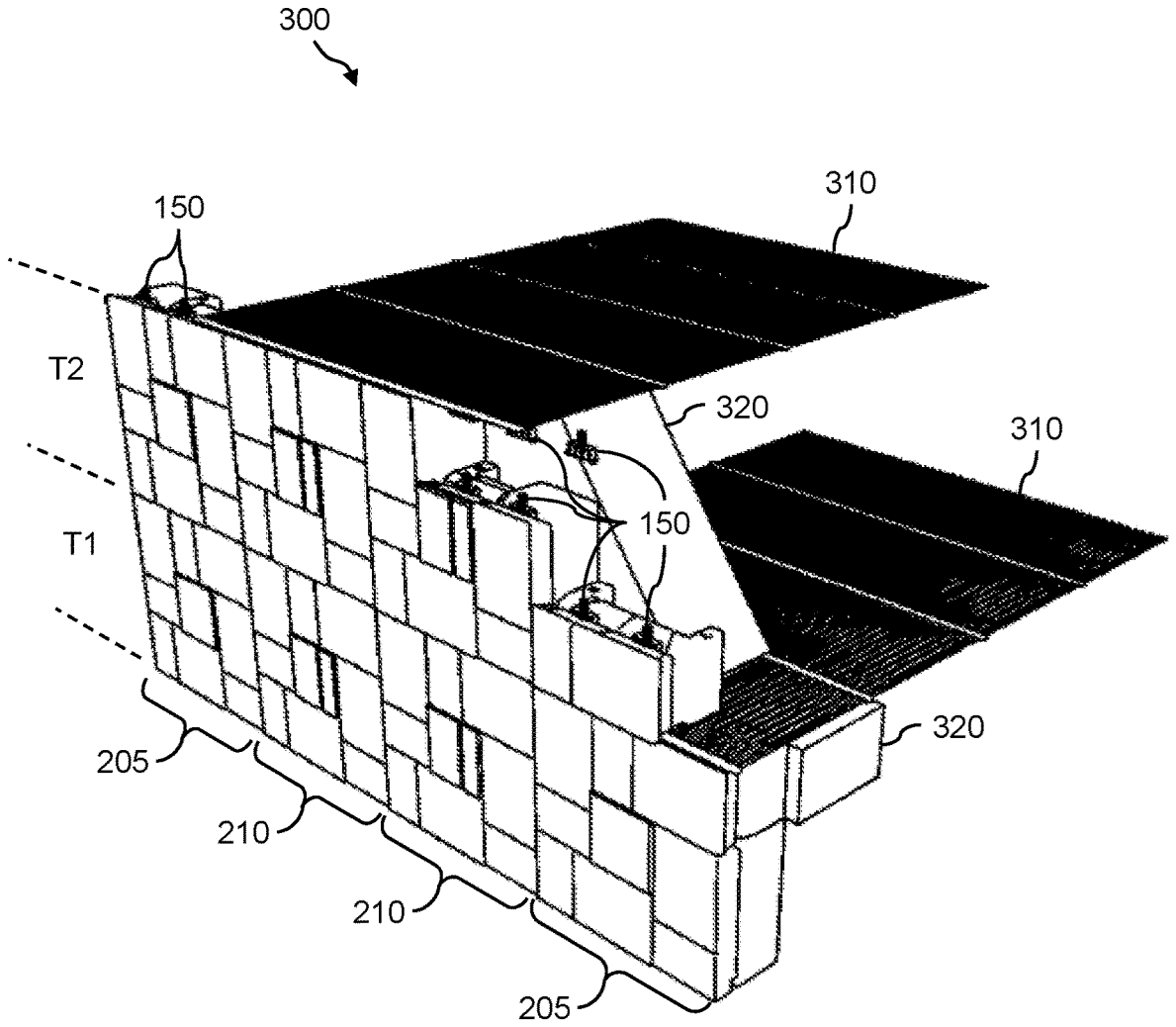
Figure 14:
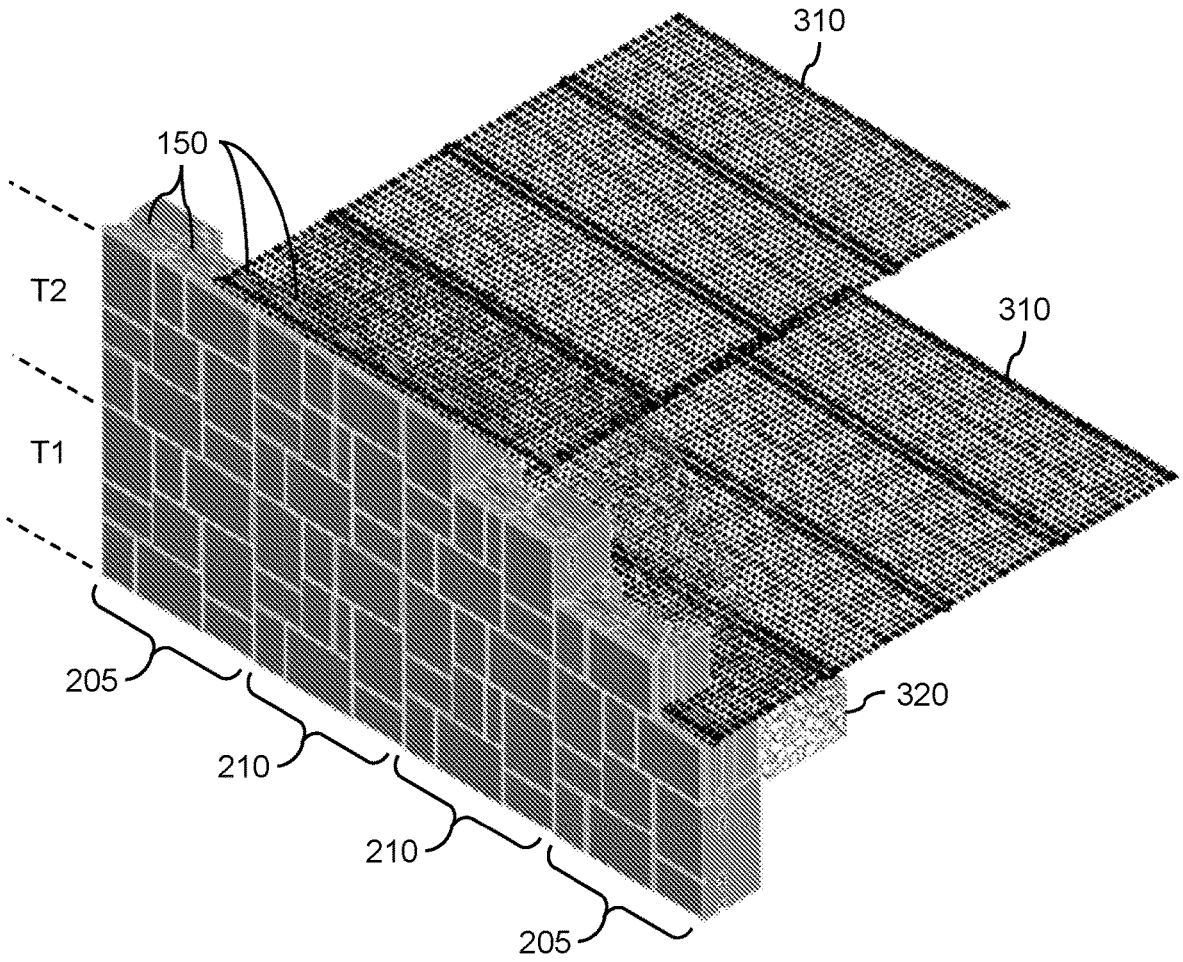
Figure 15:
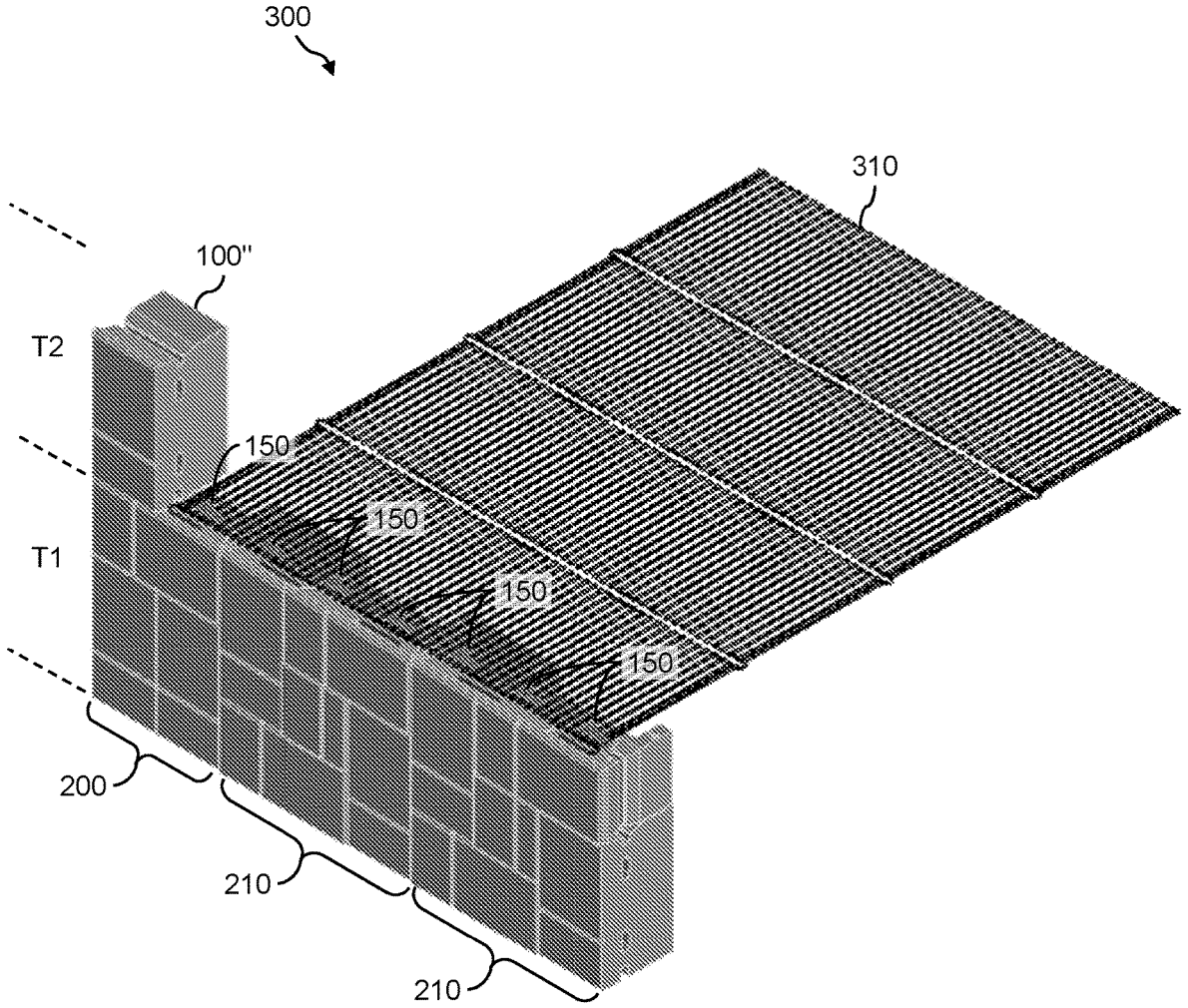
Figure 16A:
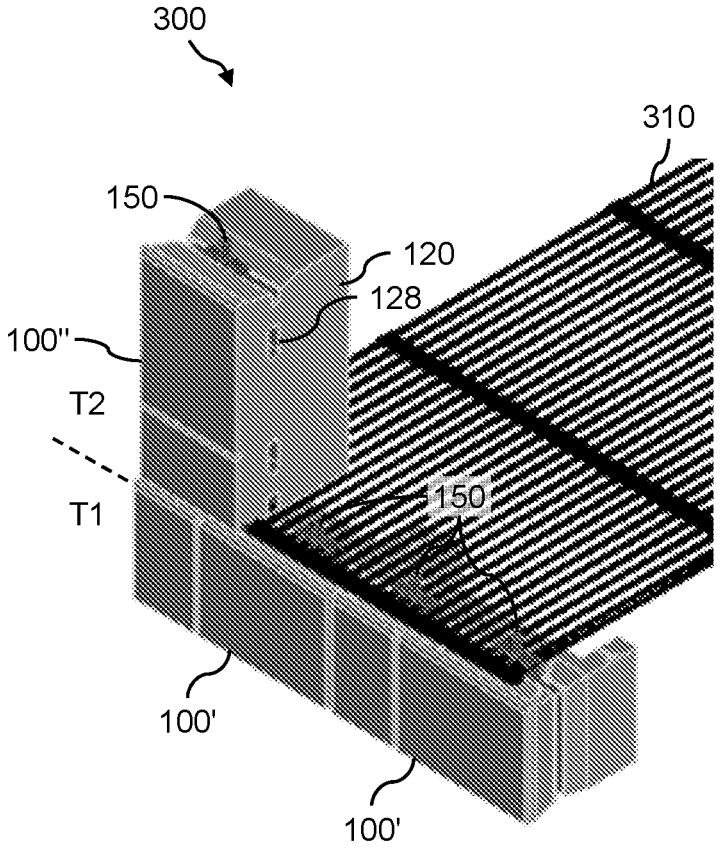
Figure 16B:
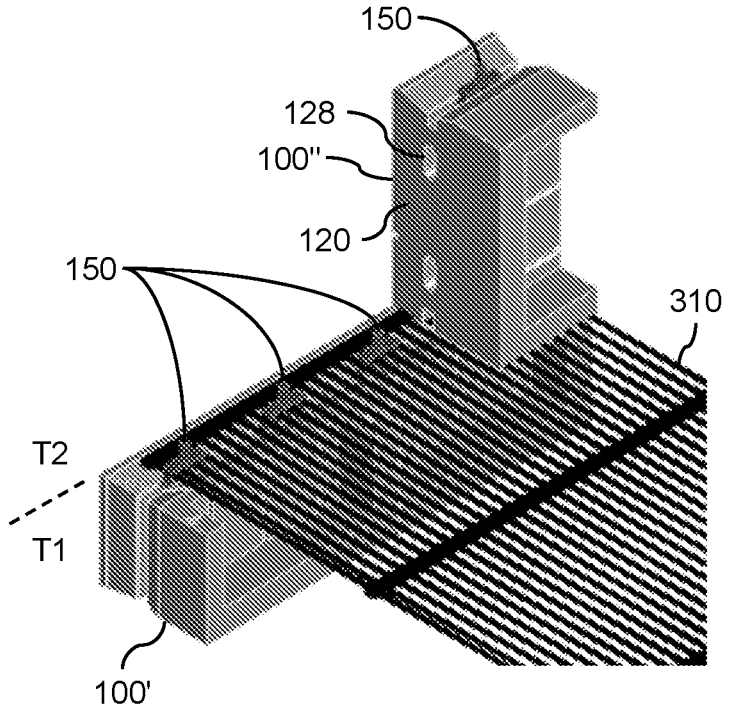
Figure 17:
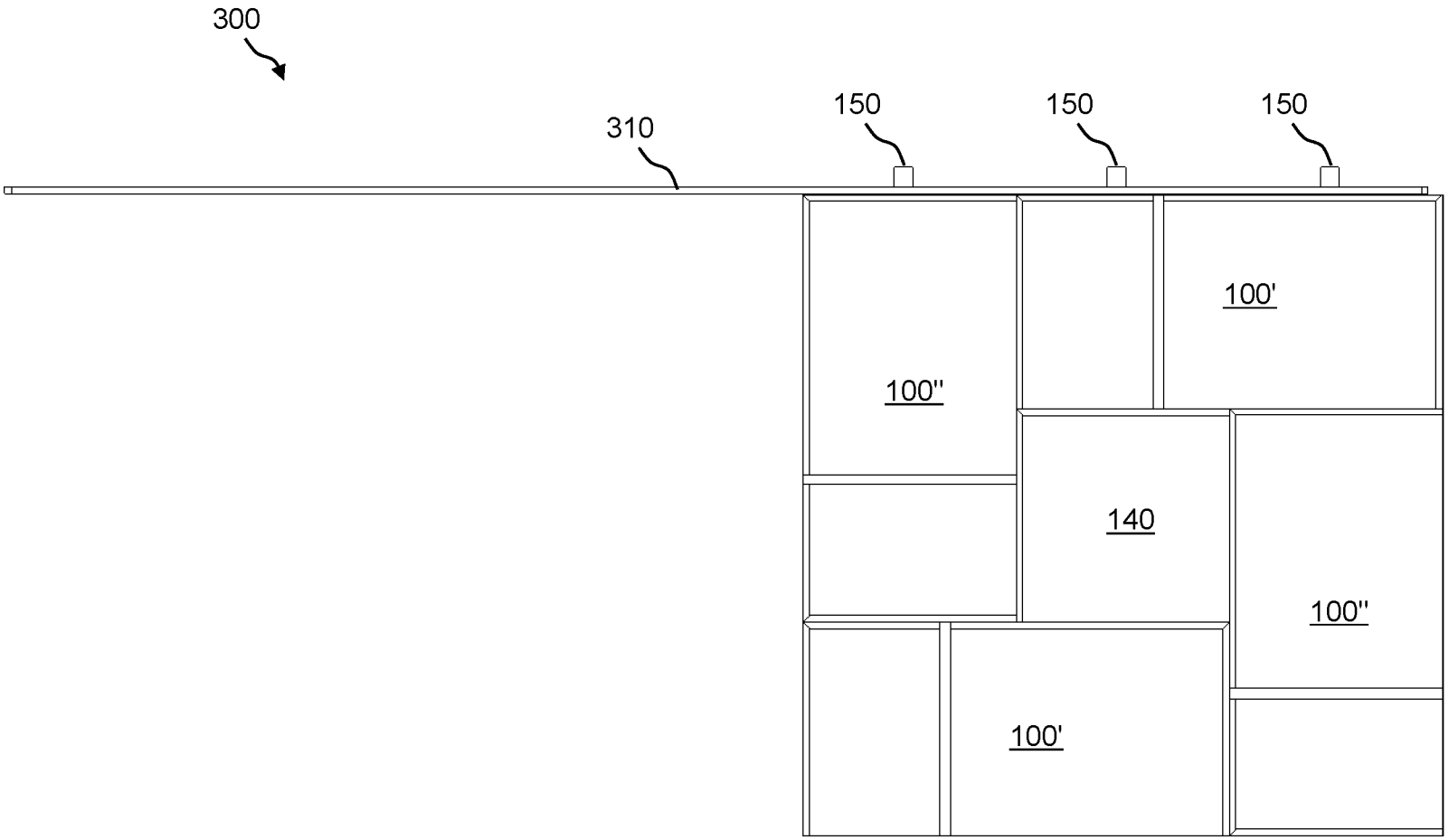
Figure 18:
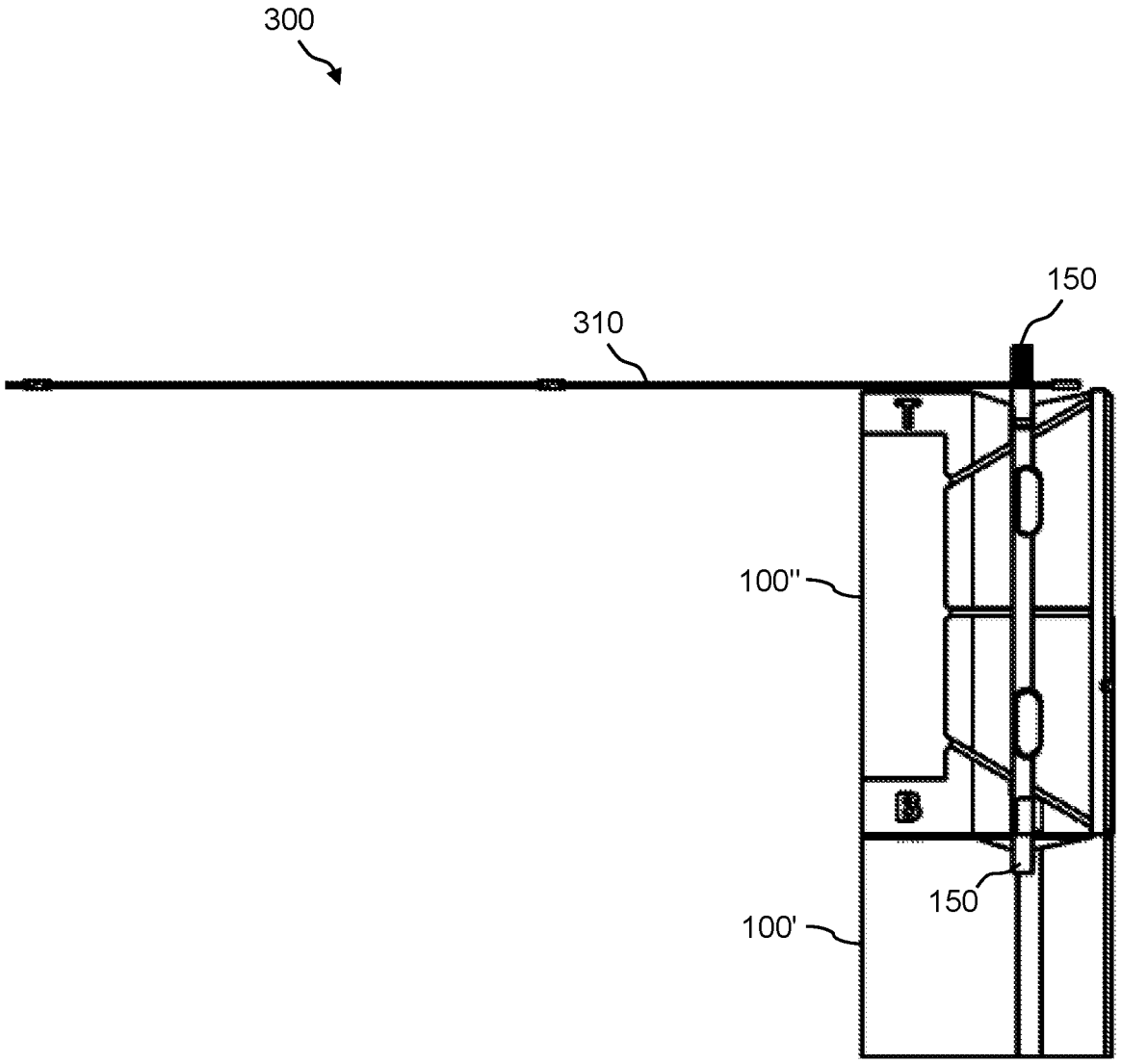
Figure 19:
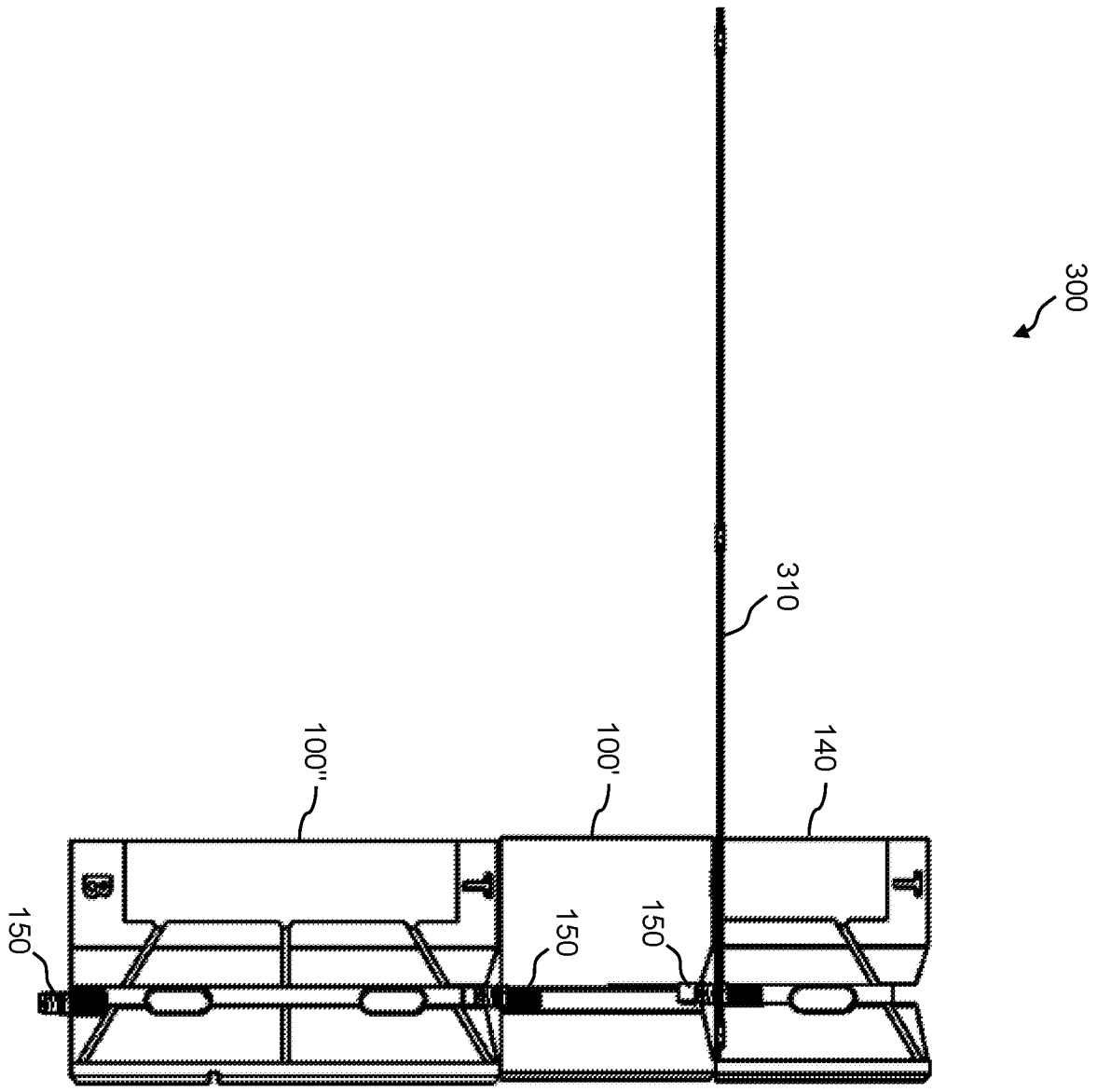
Figure 20:
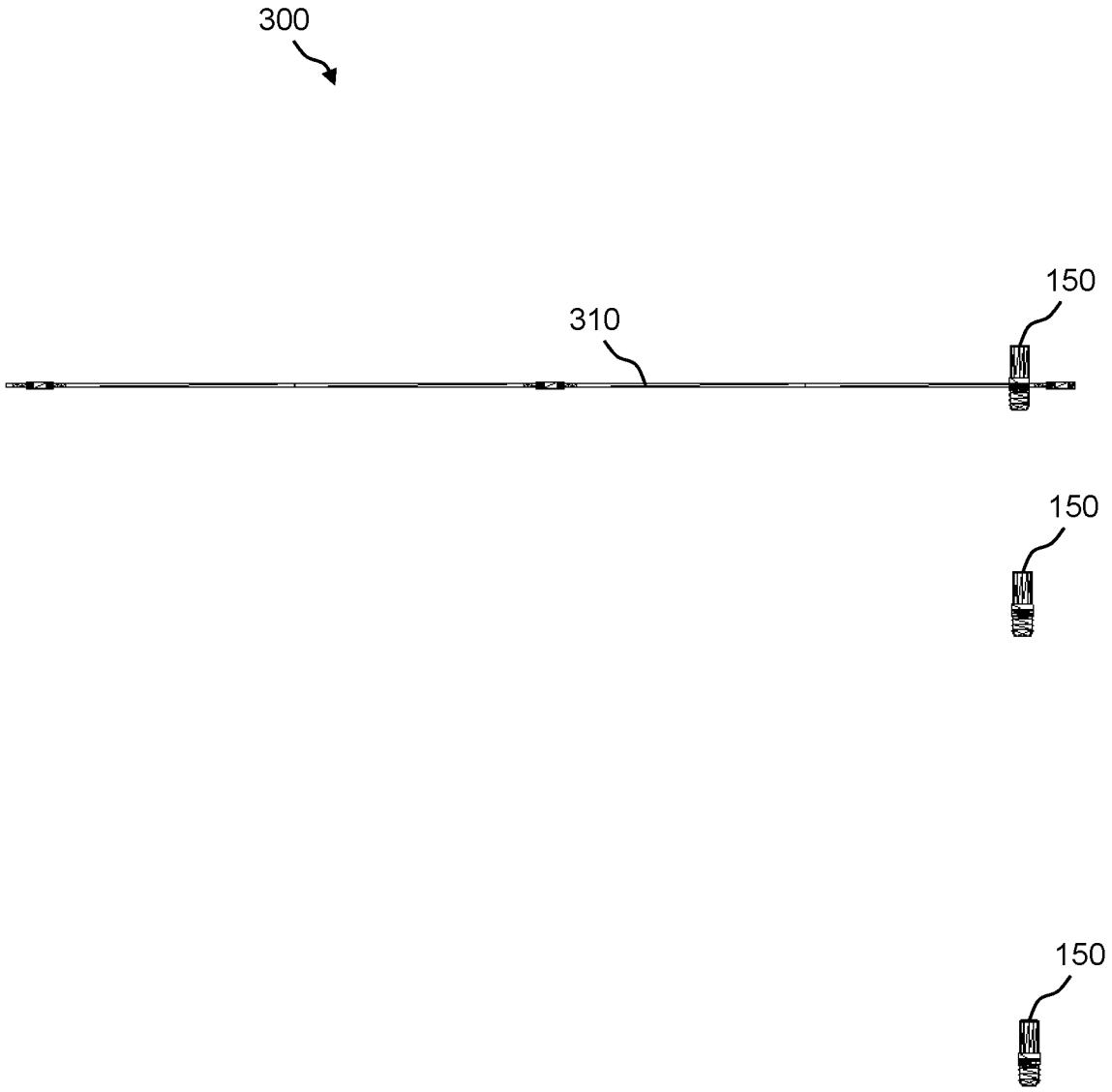
Figure 21:
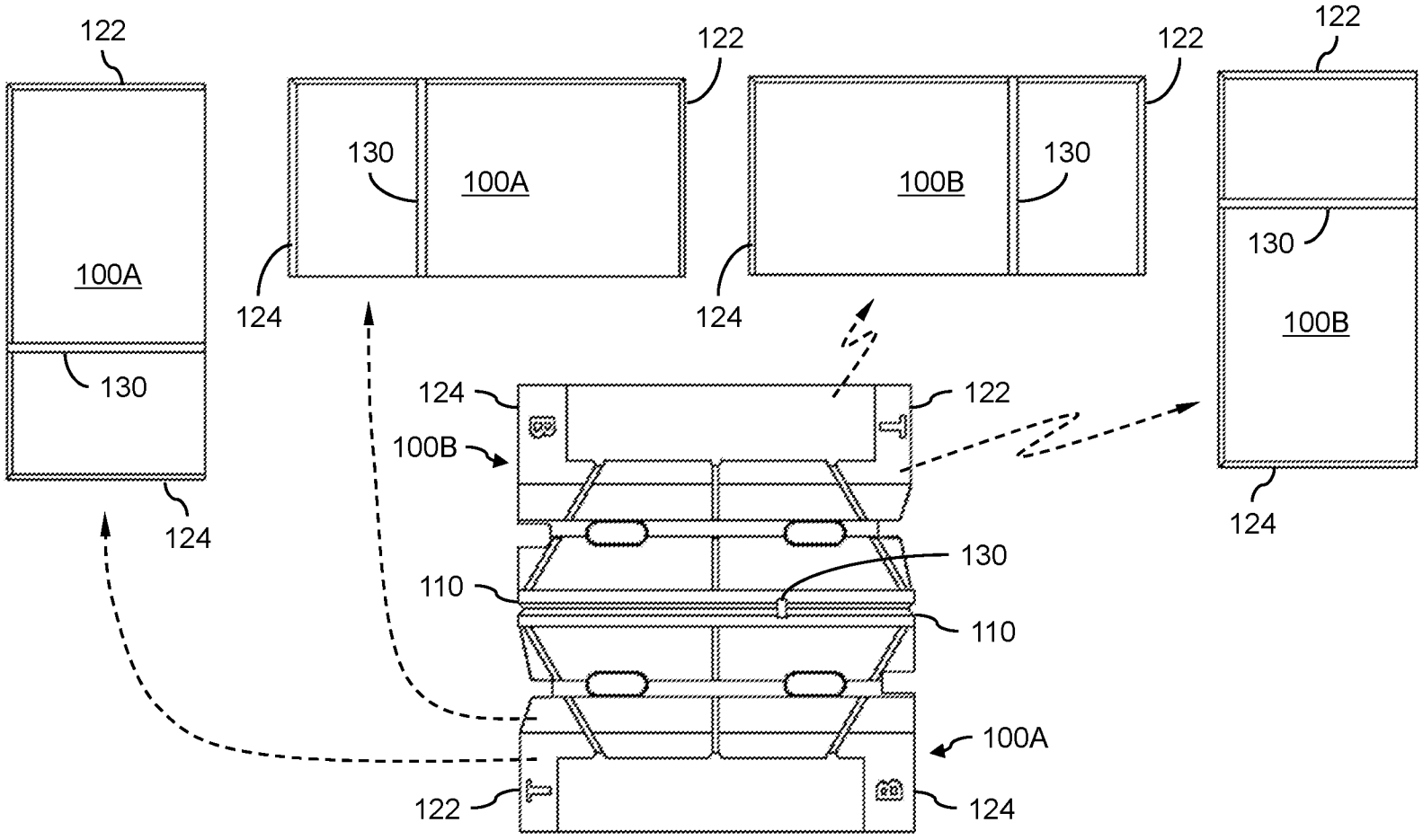
Figure 22:
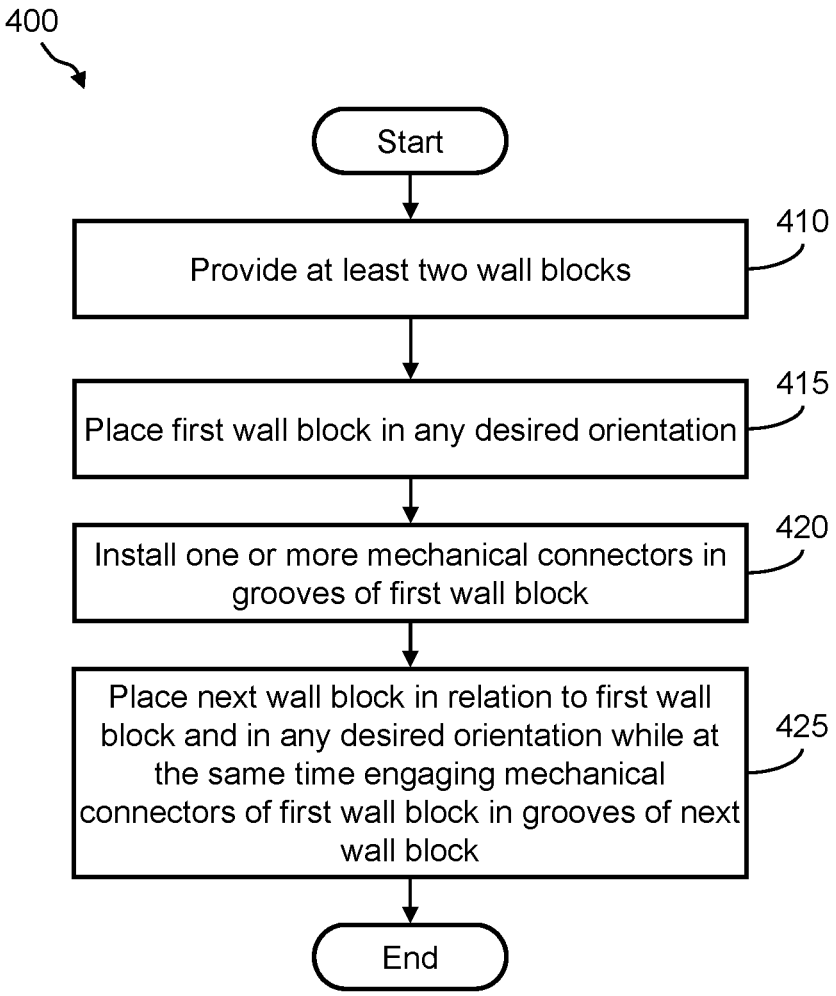
Figure 23:
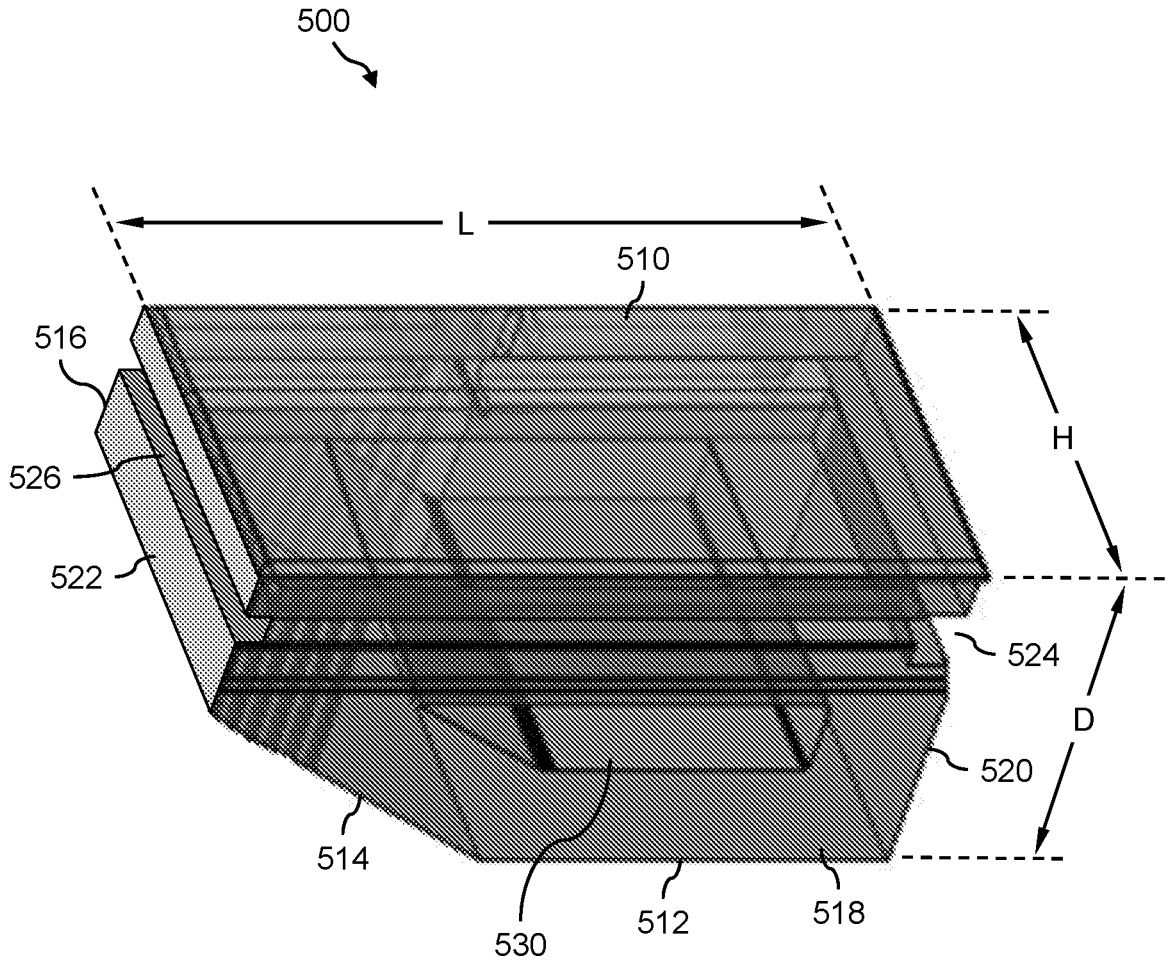
Figure 24:
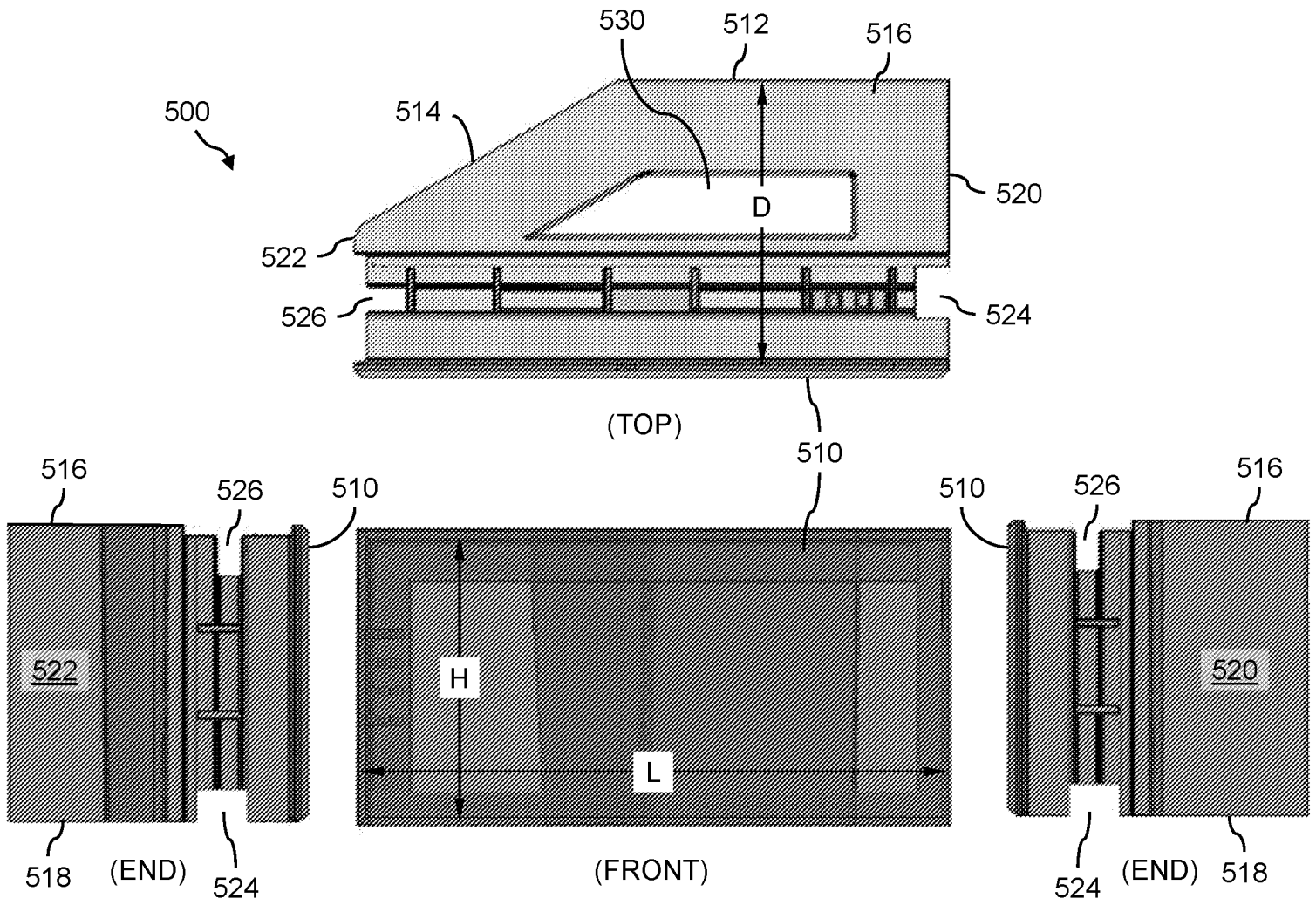
Figure 25:
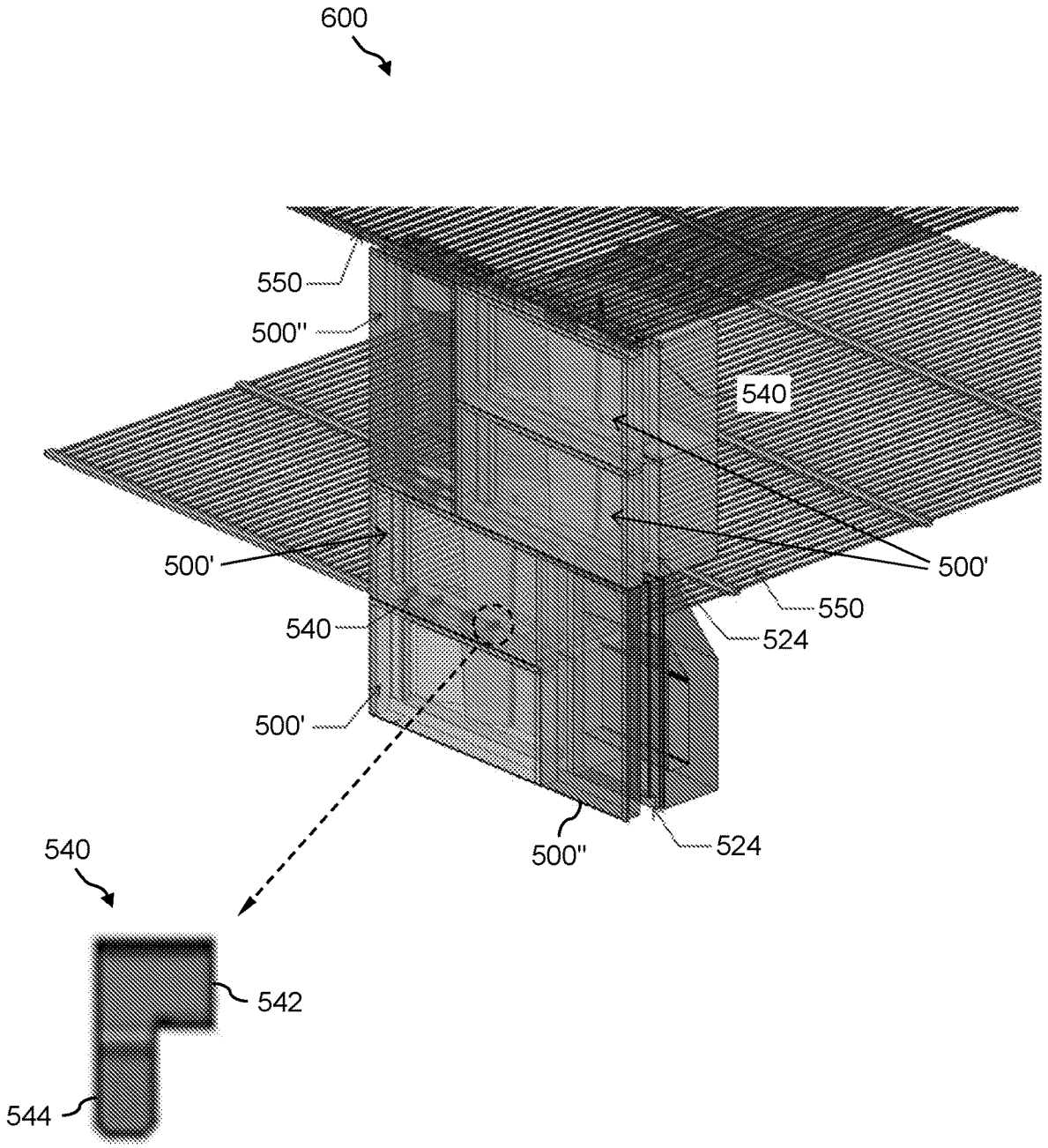
Figure 26:
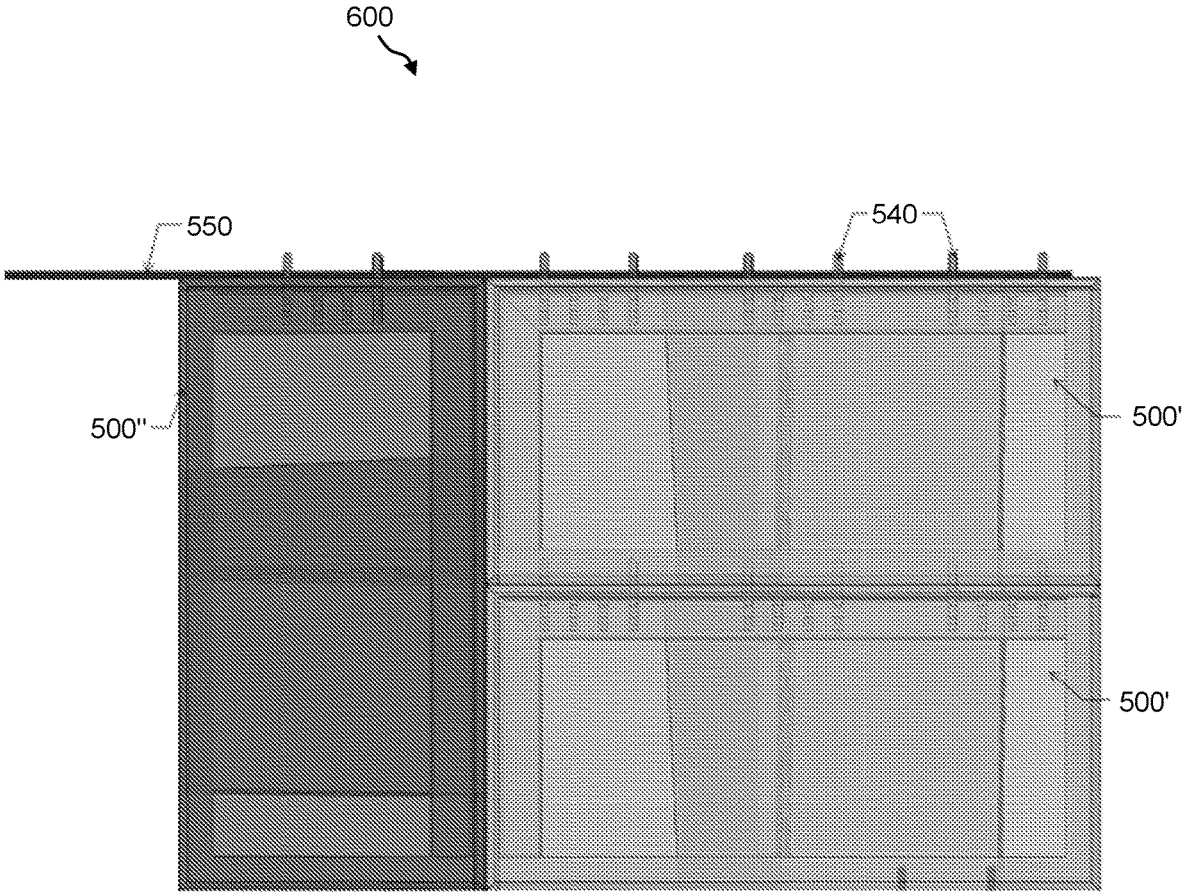
Figure 27:
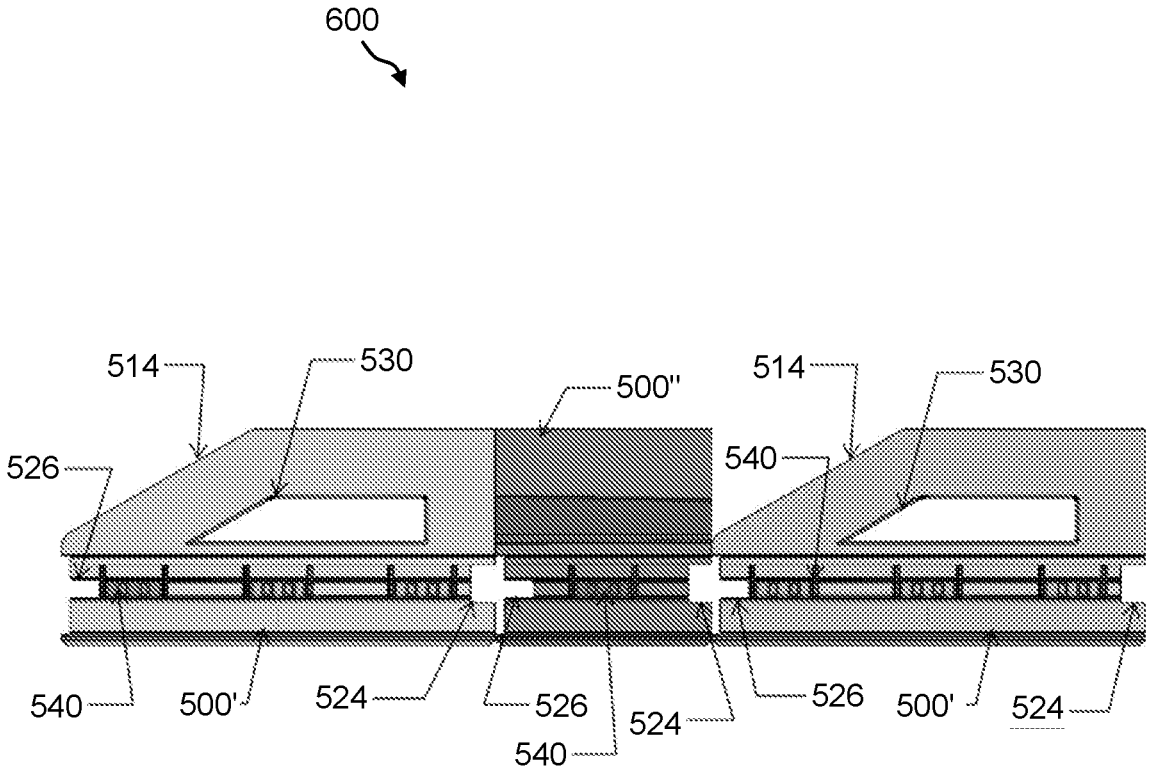
Figure 28:
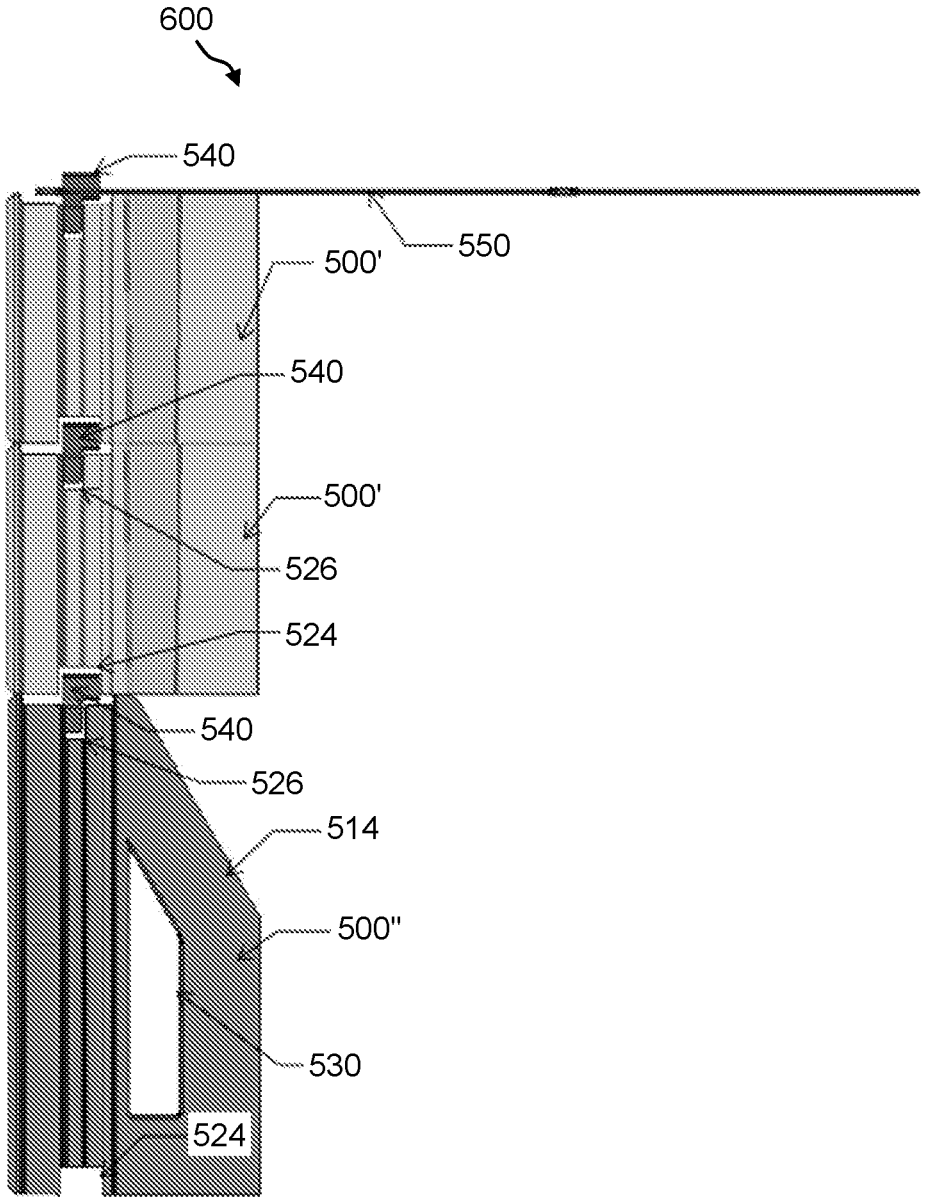
Figure 29:
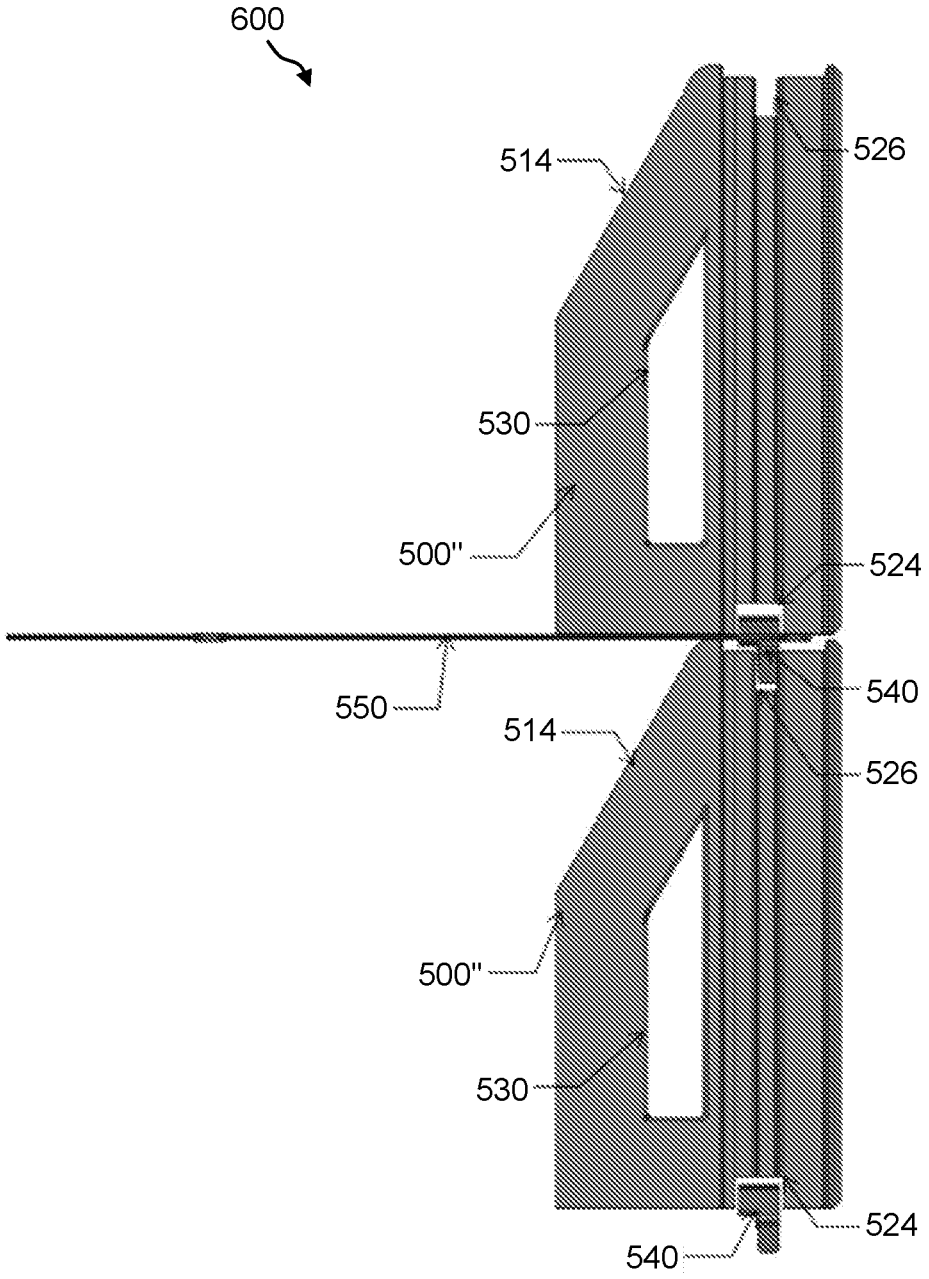
Figure 30:
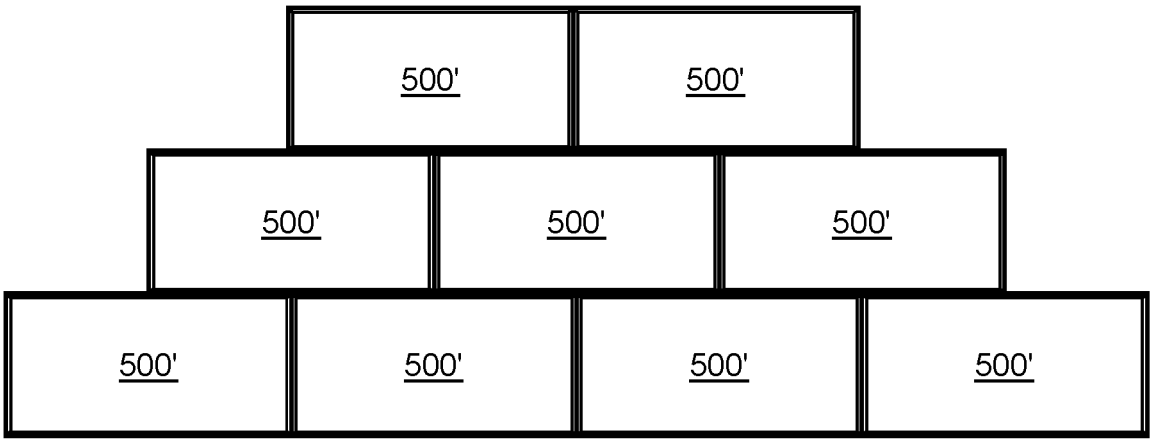
Figure 32:
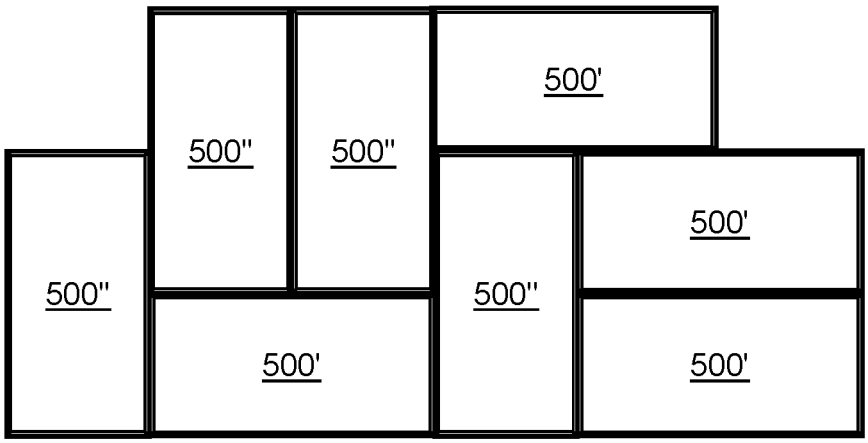
Figure 33:
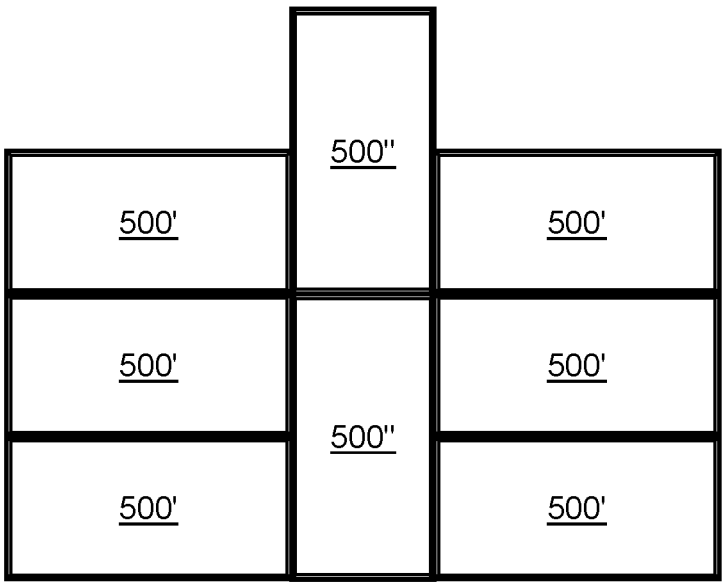
Figure 34:
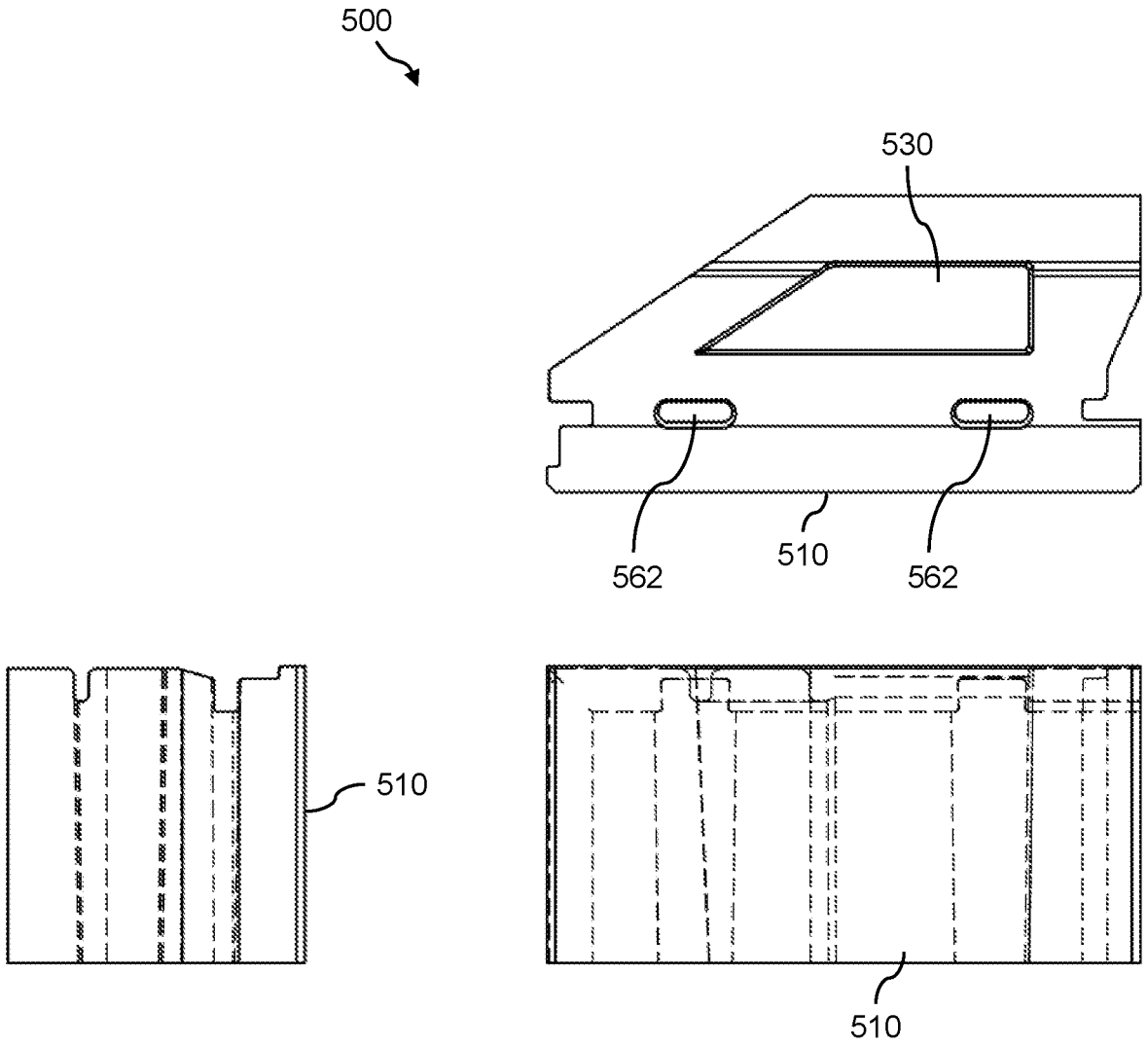
Figure 35:
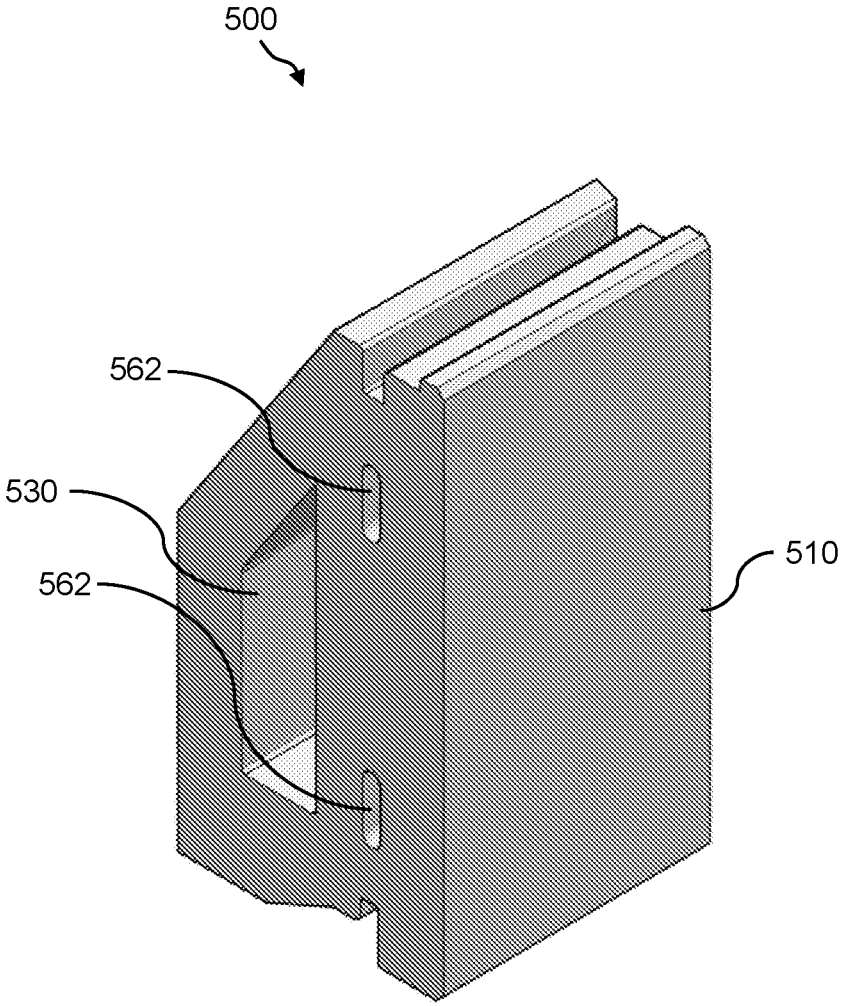

Having thus described the presently disclosed subject matter in general terms, reference will now be made to the accompanying Drawings, which are not necessarily drawn to scale, and wherein:

FIG. 1, FIG. 2, and FIG. 3 illustrate various views of one example of the presently disclosed wall block, which is a full-length wall block;

FIG. 4 and FIG. 5 illustrate various views of another example of the presently disclosed wall block;

FIG. 6 illustrates a perspective view of an example of a top-half wall block, which is another example of the presently disclosed wall blocks;

FIG. 7 illustrates a perspective view of an example of a bottom-half wall block, which is yet another example of the presently disclosed wall blocks;

FIG. 8, FIG. 9, FIG. 10, FIG. 11A, and FIG. 11B illustrate various views of an example of a mechanical connector for use with the presently disclosed wall blocks;

FIG. 12A, FIG. 12B, and FIG. 12C illustrate example configurations of the presently disclosed wall blocks that may be used to form the soil reinforcing system;

FIG. 13 and FIG. 14 illustrate perspective views of an example of a soil reinforcing system that includes an arrangement of the presently disclosed wall blocks;

FIG. 15 illustrates a perspective view of another example of a soil reinforcing system that includes an arrangement of the presently disclosed wall blocks;

FIG. 16A and FIG. 16B illustrate close-up views of yet another example of a soil reinforcing system that includes an arrangement of the presently disclosed wall blocks;

FIG. 17 illustrates a front view of a portion of a soil reinforcing system, which shows the mechanical connectors engaging with a soil reinforcing element;

FIG. 18 and FIG. 19 illustrate side views of a portion of the soil reinforcing system, which shows the mechanical connectors engaging with the soil reinforcing element and the presently disclosed wall blocks;

FIG. 20 illustrates a side view of the soil reinforcing system shown in FIG. 18 and FIG. 19, but absent the presently disclosed wall blocks;

FIG. 21 illustrates various views showing a process of making wall blocks with grooves at different locations on the front face;

FIG. 22 illustrates a flow diagram of an example of a method of using the presently disclosed wall blocks;

FIG. 23 illustrates a perspective view of another example of the presently disclosed wall block, wherein the wall block can be used to form retaining walls and/or any other soil reinforcing system;

FIG. 24 illustrates a front view, a top view, and two end views of the wall block shown in FIG. 23;

FIG. 25 illustrates a perspective view of an example of a soil reinforcing system that includes an arrangement of the presently disclosed wall blocks;

FIG. 26 illustrates a close up front view of a portion of the soil reinforcing system shown in FIG. 25;

FIG. 27, FIG. 28, and FIG. 29 illustrate views of other examples of soil reinforcing systems formed using an arrangement of the presently disclosed wall blocks;

FIG. 30, FIG. 31, FIG. 32, and FIG. 33 illustrate front views of examples of various arrangements of the presently disclosed wall blocks; and FIG. 34 and FIG. 35 illustrate various views of yet another example of the presently disclosed wall block.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides multi-oriented segmental wall blocks, a soil reinforcing system, and methods related thereto. The presently disclosed multi-oriented segmental wall blocks can be, for example, concrete masonry blocks used for constructing retaining walls. The wall blocks may allow for the formation of variable architectural patterns utilizing singular concrete facing elements that have multiple orientation configurations.

The presently disclosed wall blocks include both "full-length" blocks and "half-length" blocks, wherein (1) "full-length" means that the ratio of the front face-length to the front face-height is approximately 2:1, thereby providing a rectangular wall block; (2) "half-length" means that the ratio of the front face-length to the front face-height is approximately 1:1, thereby providing a substantially square wall block; and (3) the "full-length" blocks and the "half-length" blocks have substantially the same heights.

An aspect of the presently disclosed wall blocks is that they may support the construction of modular block wall systems, wherein the wall block designs can be used in either the horizontal or vertical orientation.

Another aspect of the presently disclosed wall blocks is that they may include a "behind the face" groove for receiving mechanical connectors for simple connection to adjacent wall blocks and/or to any other soil reinforcing elements, such as, but not limited to, a geogrid.

Yet another aspect of the presently disclosed wall blocks is that they may be oriented in the horizontal or vertical direction and still maintain connection with other wall blocks as well as with any other soil reinforcing elements.

Still another aspect of the presently disclosed wall blocks is that they may feature decreased block weight as compared with conventional wall blocks.

Referring now to FIG. 1, FIG. 2, and FIG. 3 is various views of one example of the presently disclosed wall block 100, which is a full-length wall block. Namely, FIG. 1 shows a perspective view from the front face, FIG. 2 shows a perspective view from the rear face, and FIG. 3 shows a front view, a side view, and end views of the wall block 100.

The wall block 100 can be, for example, a concrete masonry block used for constructing retaining walls, such as the soil reinforcing system shown in FIG. 13 through FIG. 16B. Namely, the wall block 100 is an example of a modular wall block. The wall block 100 includes a front face 110. Further, a cavity is formed in the rear portion of the wall block 100 forming an inner rear face 112 and an outer rear face 114. The U-shaped outer rear face 114 is the face of a protruding wall around three sides of the inner rear face 112. Further, a rear block shelf 116 is form by the arrangement of the inner rear face 112 and the outer rear face 114. The wall block 100 further includes a troughed top face 118, and a flat bottom face 120. Further, the wall block 100 has a first side face 122 and a second side face 124. With respect to the outer rear face 114, it runs around inner rear face 112 on the first side face 122, the second side face 124, and the flat bottom face 120 of the wall block 100.

In this example, a "T" imprint feature is provided on the troughed top face 118 to indicate the first side face 122 of the wall block 100 (to indicate "Top" when vertically oriented). Similarly, a "B" imprint feature is provided on the troughed top face 118 to indicate the second side face 124 of the wall block 100 (to indicate "Bottom" when vertically oriented).

Further, a trough 126 is provided along the troughed top face 118 and then continues around the corner and along the first side face 122. Additionally, two hollow open cores 128 pass through the wall block 100, extending from the troughed top face 118 to the flat bottom face 120. It is understood that more, or less, open cores 128 could be provided.

Further, the front face 110 may have one or more grooves or line features 130 of such width and depth as to create the appearance of the block face being comprised of multiple pieces. Also, the front face 110 can be textured to provide a certain appearance and/or aesthetic. Further, multiple score lines 132 are typically provided on the troughed top face 118 of the wall block 100. The score lines 132 may be used to facilitate splitting or cutting of the wall block 100 to form corners, angles or other geometric shapes.

The wall block 100 has a length L, a height H, and a depth D. The length L of the wall block 100 can generally be from about 12 inches (30.48 cm) to about 24 inches (60.96 cm), and in one example is about 16 inches (40.64 cm). The height H of the wall block 100 can generally be from about 6 inches (15.24 cm) to about 12 inches (30.48 cm), and in one example is about 8 inches (20.32 cm). The depth D of the wall block 100 can generally be from about 5 inches (12.7 cm) to about 15 inches (38.1 cm), and in one example is about 9 inches (22.86 cm). The ratio of length L to height H is approximately 2:1 to allow for both horizontal alignment and vertical alignment with the same facing element (see FIG. 12A, FIG. 12B, and FIG. 12C).

In one example, the wall block 100 has a length L of about 16 inches (40.64 cm), a height H of about 8 inches (20.32 cm), and a depth D of about 9 inches (22.86 cm), which provides the end customer with more aesthetic pattern choices using one mold and block style only, and decreased time for delivery compared with those of varying sized blocks and therefore reduce the overall cost of structure. In this example, the U-shaped outer rear face 114 creates the rear block shelf 116. The function of the rear block shelf 116 is to capture soil and/or stone fill, which increases the overturning resistance of the wall block 100. Further, the rear block shelf 116 allows for reductions to the block weight without compromising the stability of the wall block 100. This is desirable feature as compared to other blocks because the weight of the block directly impacts the delivery, handling and installation costs of the wall structure. The weight of the wall block 100 is about 65 lbs (29.48 kg), which is a decrease as compared with conventional wall blocks that typically weigh about 75 lbs (34.02 kg) to 90 lbs (40.82 kg). The "T" imprint feature and the "B" imprint feature 133 on the U-shaped outer rear face 114 serve as indicators to differentiate top (i.e., first side face 122) and bottom (i.e., second side face 124) when the wall block 100 is set vertically.

The wall block 100 can be used in combination with one or more connectors, such as mechanical connectors 150 (see FIG. 8 through FIG. 11B), to connect one wall block 100 to another wall block and/or to certain soil reinforcing elements (see FIG. 13 through FIG. 16B). Accordingly, certain grooves are typically provided around three sides of the periphery of wall block 100; namely, around and behind three sides of the periphery of the front face 110. For example, a groove 134 is provided along the troughed top face 118 and the first side face 122 of the wall block 100. The groove 134 has a certain width and depth. Further, a groove 136 is provided along the second side face 124 of the wall block 100. The groove 136 has a certain width and depth that is different than that of the groove 134. Namely, hereafter the groove 134 will be called the narrow groove 134 and the groove 136 will be called the wide groove 136. The narrow groove 134 and the wide groove 136 are designed to receive one or more mechanical connectors 150, wherein the narrow groove 134 is sized to receive serrated leg members 154 (see FIG. 8 through FIG. 11B) of the mechanical connectors 150 and the wide groove 136 is sized to receive a cylinder-shaped peg member 158 (see FIG. 8 through FIG. 11B) of the mechanical connectors 150. Further, the peg member 158 of the mechanical connectors 150 can fit into the open cores 128 to provide alignment, shear capacity between the wall blocks 100, and to allow side-to-side rotation of the wall block 100 to form radii and corners.

FIG. 4 and FIG. 5 illustrate various views of another example of the presently disclosed wall block 100. Namely, FIG. 4 shows a perspective view from the flat bottom face 120 of the wall block 100, while FIG. 5 shows a front view, a side view, and an end view of the wall block 100. In this example of the wall block 100, the groove 134 that is along the troughed top face 118 is also added to the flat bottom face 120 of the wall block 100. While FIG. 4 and FIG. 5 show the two open cores 128 present, in yet another example, the wall block 100 shown in FIG. 4 and FIG. 5 can be absent the two open cores 128. That is, the groove 134 on both the troughed top face 118 and the flat bottom face 120 of the wall block 100 can replace the two open cores 128. This may be a preferable method for some manufactures in that the block may be produced either with or without requiring certain equipment, such as a core puller.

Referring now to FIG. 6 is a perspective view of an example of a top-half wall block 140, which is another example of the presently disclosed wall blocks. Like the wall block 100, the top-half wall block 140 is an example of a modular wall block. Also, like the wall block 100, the top-half wall block 140 can be, for example, a concrete masonry block used for constructing retaining walls. The top-half wall block 140 has substantially the same features and/or components as the wall block 100, albeit the top half only of the wall block 100. The "top" half being the half of the wall block 100 that includes the first side face 122 as indicated by the "T" imprint feature.

The top-half wall block 140 has a length L, a height H, and a depth D. The height H and the depth D of the top-half wall block 140 are substantially the same as the height H and depth D, respectively, of the wall block 100. However, the length L of the top-half wall block 140 is about half the length L of the wall block 100.

Referring now to FIG. 7 is a perspective view of an example of a bottom-half wall block 145, which is yet another example of the presently disclosed wall blocks. Like the wall block 100, the bottom-half wall block 145 is an example of a modular wall block. Also, like the wall block 100, the bottom-half wall block 145 can be, for example, a concrete masonry block used for constructing retaining walls. The bottom-half wall block 145 has substantially the same features and/or components as the wall block 100, albeit the bottom half only of the wall block 100. The "bottom" half being the half of the wall block 100 that includes the second side face 124 as indicated by the "B" imprint feature.

The bottom-half wall block 145 has a length L, a height H, and a depth D. The height H and the depth D of the bottom-half wall block 145 are substantially the same as the height H and depth D, respectively, of the wall block 100. However, the length L of the bottom-half wall block 145 is about half the length L of the wall block 100.

The terms "top," "bottom," "front," "back," "rear," "over," "under," "side" and "on" are used throughout the description with reference to the relative positions of components of the wall blocks 100, the top-half wall blocks 140, and the bottom-half wall blocks 145, such as relative positions of the front, rear, top, and bottom faces of the wall blocks. It will be appreciated that the wall blocks 100, the top-half wall blocks 140, and the bottom-half wall blocks 145 are functional regardless of their orientation in space.

Optionally, the top-half wall block 140 and the bottom-half wall block 145 can include the groove 134 on both the troughed top face 118 and the flat bottom face 120, as described in FIG. 4 and FIG. 5 with respect to the wall block 100. With that, optionally the top-half wall block 140 and the bottom-half wall block 145 can be absent the open core 128. Further, like the wall block 100, the top-half wall block 140 and the bottom-half wall block 145 can be used in combination with one or more connectors, such as mechanical connectors 150 (see FIG. 8 through FIG. 11B), to connect one wall block to another wall block and/or to certain soil reinforcing elements (see FIG. 13 through FIG. 16B).

Figure 8:
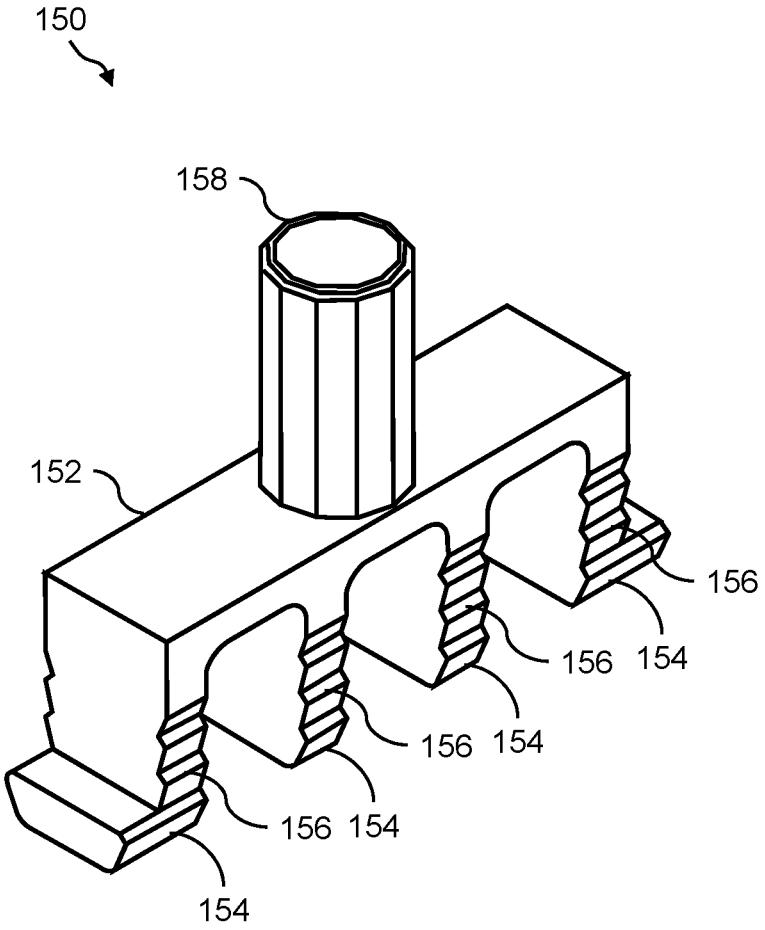
Figure 9:
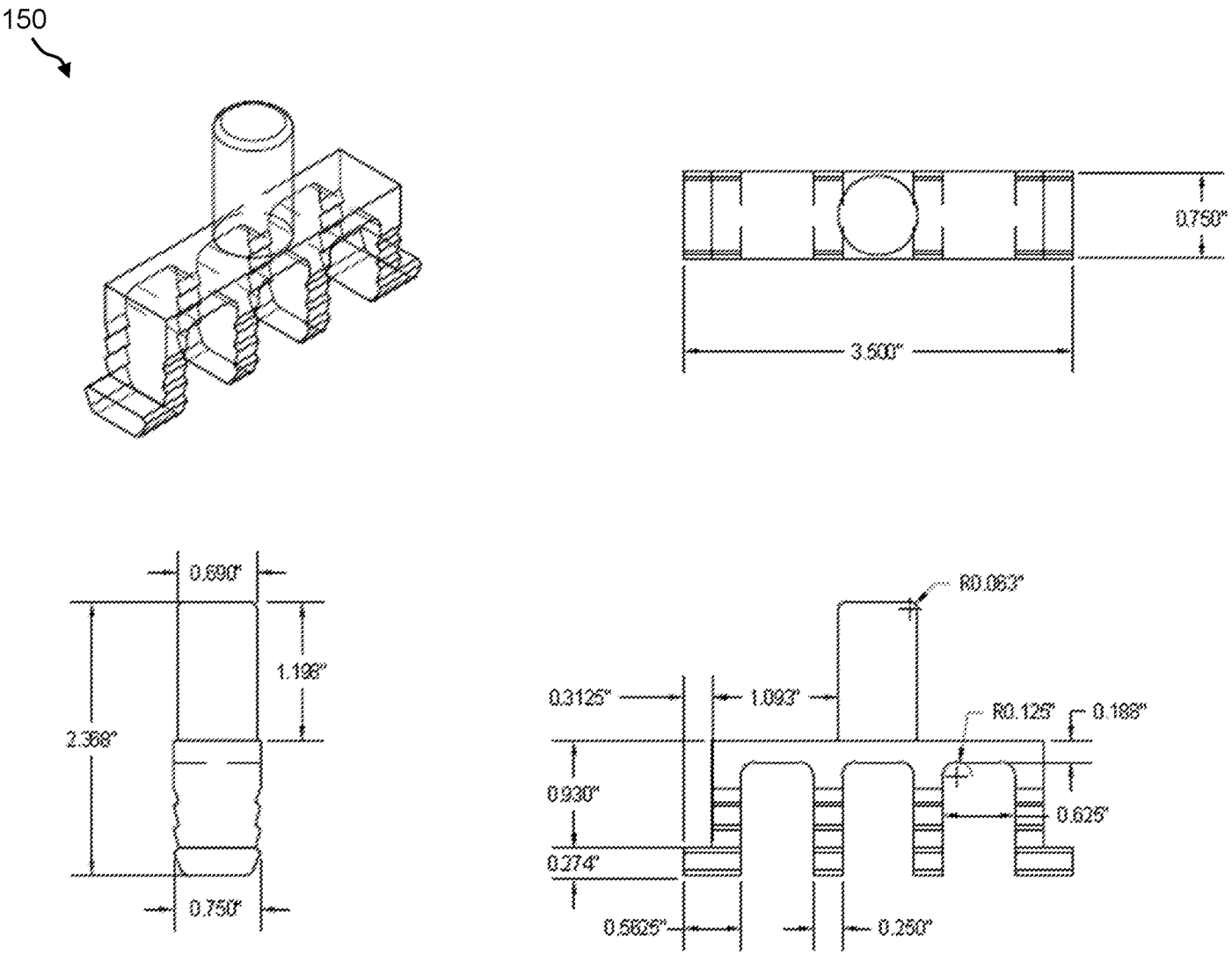
Figure 10:
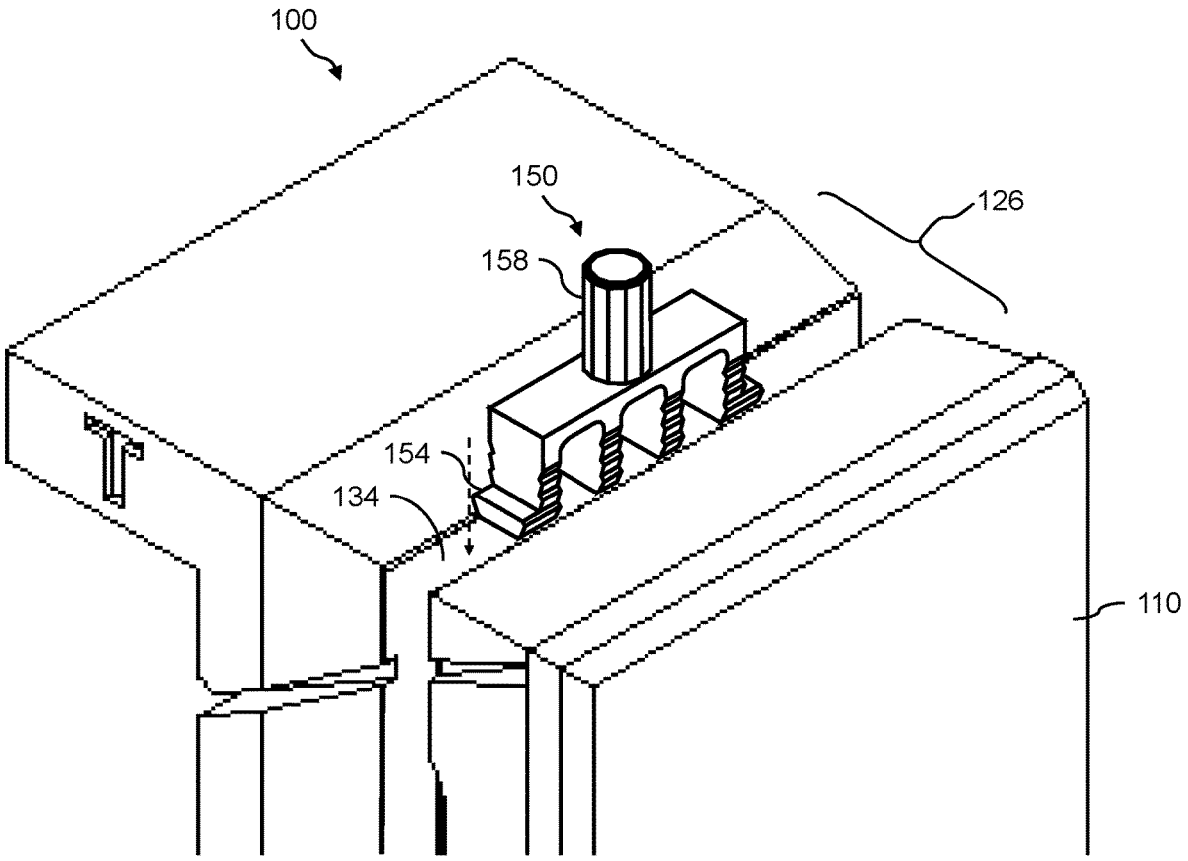
Figure 11A:
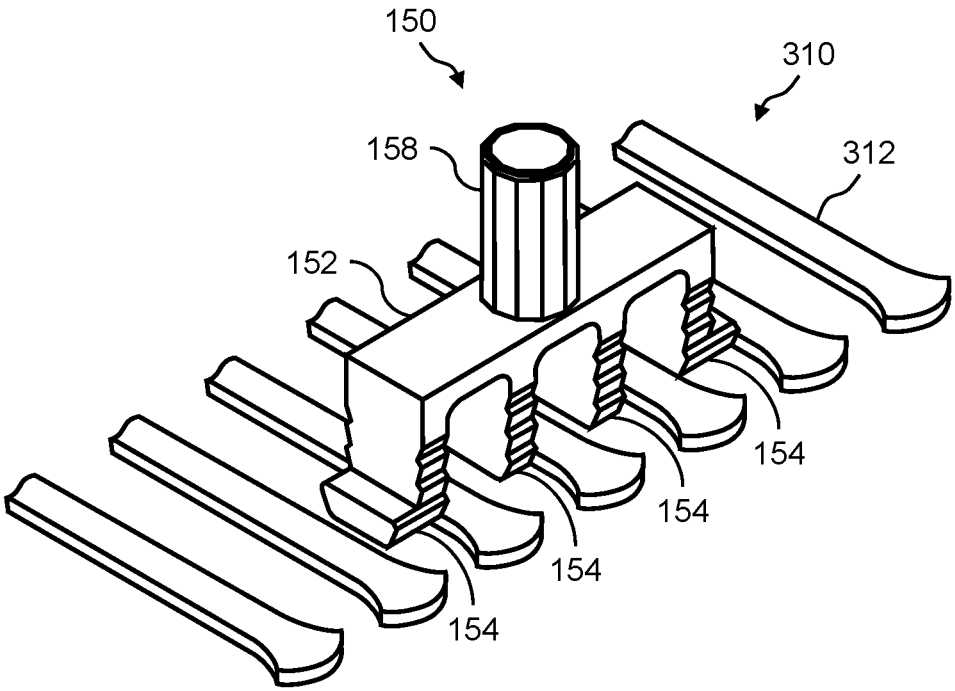
Figure 11B:
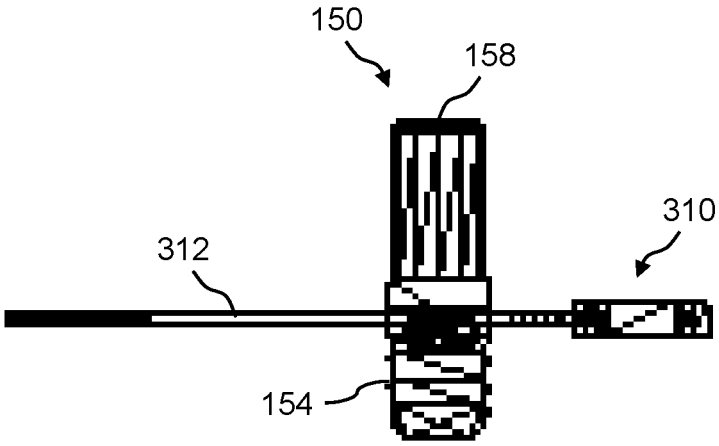

FIG. 8 through FIG. 11B illustrate various views of an example of the mechanical connector 150 for use with the presently disclosed wall blocks 100. Namely, FIG. 8 is a perspective view of the mechanical connector 150, FIG. 9 is various views showing example dimensions of the mechanical connector 150, FIG. 10 shows an example of the mechanical connector 150 engaging with the wall block 100, and FIG. 11A and FIG. 11B is a perspective view and side view, respectively, of an example of the mechanical connector 150 engaging with the edge of a soil reinforcing element.

Referring now to FIG. 8, the mechanical connector 150 typically includes a cross bar member 152. A set of serrated leg members 154 protrude from one side of the cross bar member 152, wherein certain ridges or ribs 156 run along the sides of the serrated leg members 154. A peg member 158 (e.g., a cylinder-shaped peg member 158) protrudes from the cross bar member 152 in the opposite direction from the serrated leg members 154. The serrated leg members 154 of the mechanical connector 150 are designed to engage with the grooves or slots (e.g., narrow groove 134) of the wall block 100, the top-half wall block 140, and the bottom-half wall block 145; an example of which is shown in FIG. 10. In particular, the ridges or ribs 156 along the sides of the serrated leg members 154 are designed to grip the walls of the grooves or slots of the wall blocks.

Further, the serrated leg members 154 of the mechanical connector 150 are designed to engage with the edge of a soil reinforcing element. For example, FIG. 11A and FIG. 11B is a perspective view and side view, respectively, of an example of the mechanical connector 150 engaging with the edge of a soil reinforcing element 310. In this example, the soil reinforcing element 310 includes an arrangement of geogrid members 312. The serrated leg members 154 of the mechanical connector 150 are spaced to be snap-fitted between the geogrid members 312. Further, the serrated leg members 154 of the mechanical connector 150 are long enough to engage first with the soil reinforcing element 310 and then with the grooves or slots of the wall blocks (e.g., narrow groove 134), as shown in FIG. 13 through 16B.

Referring again to FIG. 1 through FIG. 11B, multiple types of wall blocks are disclosed herein. For example, a full-length wall block is provided, which is the wall block 100. As used herein, "full-length" means that the ratio of the front face-length to the front face-height is approximately 2:1, thereby providing a rectangular wall block. In a soil reinforcing system, such as shown in FIG. 13 through FIG. 16B, those wall blocks 100 that are aligned with their long axis horizontal are hereafter called horizontal wall blocks 100', while those wall blocks 100 that are aligned with their long axis vertical are hereafter called vertical wall blocks 100". Other types of wall blocks include half-length wall blocks, such as the top-half wall block 140 and the bottom-half wall block 145. As used herein, "half-length" means that the ratio of the front face-length to the front face-height is approximately 1:1, thereby providing a substantially square wall block. Further, the wall block 100, the top-half wall block 140, and the bottom-half wall block 145 have substantially the same heights.

A multitude of patterns may be arrived at to form a soil reinforcing system, such as shown in FIG. 13 through FIG. 16B, by varying the horizontal and/or vertical alignments of the wall blocks 100 and varying the selection of the top-half wall blocks 140 and the bottom-half wall blocks 145. For example, FIG. 12A, FIG. 12B, and FIG. 12C show example configurations of the presently disclosed wall blocks that may be used to form a soil reinforcing system. Namely, in FIG. 12A, a block configuration 200 includes one horizontal wall block 100' arranged atop two vertical wall blocks 100", providing a rectangular block pattern that can be repeated. In FIG. 12B, a block configuration 205 includes two horizontal wall blocks 100', plus two vertical wall blocks 100", plus one top-half wall block 140, providing a square block pattern that can be repeated. In FIG. 12C, a block configuration 210 includes two horizontal wall blocks 100', plus two vertical wall blocks 100", plus one bottom-half wall block 145, providing a square block pattern that can be repeated. In the block configuration 210, the bottom-half wall block 145 has a line feature that provides a slightly different appearance and aesthetic as compared with the block configuration 205 in FIG. 12B.

Referring now to FIG. 13 and FIG. 14 is perspective views of an example of a soil reinforcing system 300 that includes an arrangement of the presently disclosed wall blocks, such as the wall blocks 100, the top-half wall blocks 140, and the bottom-half wall blocks 145. The soil reinforcing system 300 can be, for example, a retaining wall or any other type of soil reinforcing system. Together, the horizontal wall blocks 100', the vertical wall blocks 100", the top-half wall blocks 140, and the bottom-half wall blocks 145 can be used to provide variability to the wall appearance and aesthetic.

In the soil reinforcing system 300 shown in FIG. 13 and FIG. 14, both the block configuration 205 of FIG. 12B and the block configuration 210 of FIG. 12C are built into the soil reinforcing system 300, which is exemplary only. The soil reinforcing system 300 is not limited to the wall block configurations and/or patterns shown in FIG. 13 and FIG. 14. Other wall block configurations and/or patterns are possible.

However, by way of example, the soil reinforcing system 300 shown in FIG. 13 and FIG. 14 includes two tiers (T1, T2). Tier T1 includes, in a line, one instance of the block configuration 205, then two instances of the block configuration 210, then another instance of the block configuration 205. Tier T2 is stacked atop Tier T1, wherein Tier T2 includes the same block configurations as Tier T1. The soil reinforcing system 300 may also include a first soil reinforcing element 310 that is integrated at the interface of Tier T1 and Tier T2 and a second soil reinforcing element 310 that may be integrated at the top of Tier T2.

In one example, the soil reinforcing elements 310 are geogrid structures. The soil reinforcing elements 310 may be, for example, a synthetic material, such as high density polyethylene (HDPE) and polyester geogrids, or may be a steel reinforcing mesh, steel strips, or other soil reinforcing elements. A "geogrid" is a grid whose primary purpose is to strengthen or reinforce soil and has open meshes into which soil particles can lock. Namely, in the process of constructing the soil reinforcing system 300, the arrangement of the horizontal wall blocks 100', the vertical wall blocks 100", the top-half wall blocks 140, the bottom-half wall blocks 145, and the soil reinforcing elements 310 is backfilled with soil 320.

In the presently disclosed soil reinforcing system 300, multiple mechanical connectors 150 may be used to couple together adjacent wall blocks 100, top-half wall blocks 140, and bottom-half wall blocks 145, as well as to couple any types of walls blocks to the soil reinforcing elements 310, as shown, for example, in FIG. 11A and FIG. 11B. The mechanical connectors 150 are designed to fit into grooves of any types of walls blocks, as well as to interlock with the soil reinforcing elements 310 (e.g., the geogrid members 312).

Referring now to FIG. 15 is a perspective view of another example of a soil reinforcing system 300 that includes an arrangement of the presently disclosed wall blocks. In this example, Tier T1 includes, in a line, two instances of the block configuration 210, then one instance of the block configuration 200. Then, a first soil reinforcing element 310 that is integrated atop Tier T1. FIG. 15 also shows the beginning vertical wall block 100" of Tier T2.

Referring now to FIG. 16A and FIG. 16B is close-up views of yet another example of a soil reinforcing system 300 that includes an arrangement of the presently disclosed wall blocks. In this example, Tier T1 includes two horizontal wall blocks 100'. Then, a first soil reinforcing element 310 is integrated atop Tier T1. FIG. 16A and FIG. 16B also show the beginning vertical wall block 100" of Tier T2.

Referring now to FIG. 17 is a front view of a portion of the soil reinforcing system 300, which shows the mechanical connectors 150 engaging with the soil reinforcing element 310 and the presently disclosed wall blocks (soil not shown). Similarly, FIG. 18 and FIG. 19 show side views of a portion of the soil reinforcing system 300, which show the mechanical connectors 150 engaging with the soil reinforcing element 310 and the presently disclosed wall blocks. FIG. 20 show a side view of the soil reinforcing system 300 shown in FIG. 18 and FIG. 19, but absent the presently disclosed wall blocks.

Referring now to FIG. 21 is various views showing a process of the making wall blocks 100 with grooves at different locations on the front face 110. Namely, FIG. 21 shows that the front face 110 of the wall block 100 may have one or more grooves or line features 130 of such width and depth as to create the appearance of the block face being comprised of multiple pieces. The grooves or line features 130 may be created with a hollow core as part of the manufacturing process involving split facing of the wall block 100.

In this example, two wall blocks 100 are produced face-to-face (i.e., one combined wall block 100A/100B), which when split create the appearance of the now split faced wall block 100A and wall block 100B being comprised of multiple pieces. The wall block 100A has the groove or line feature 130 to the left side thereof and the wall block 100B has the groove or line feature 130 to the right side thereof. When the wall block 100A and wall block 100B are rotated in the vertical configuration, the addition of the groove or line feature 130 creates the appearance of additional facing blocks while utilizing only one block size. Additional aesthetic patterns and appearances may be created by additional insert shapes and sizes between the split faced wall blocks 100A and 100B. Further, in this example, uniquely shaped splitter knives (not shown) can be used to split the initially combined wall block 100A/100B into separate wall blocks 100A and 100B.

FIG. 22 illustrates a flow diagram of an example of a method 400 of using the presently disclosed wall blocks 100 in a simple configuration of two wall blocks 100. While the method 400 is described with reference to the wall blocks 100 only, the method 400 is applicable to any of the wall blocks 100, the top-half wall blocks 140, the bottom-half wall blocks 145, and any combinations thereof. The method 400 may include, but is not limited to, the following steps.

At a step 410, at least two of the presently disclosed wall blocks 100 are provided.

At a step 415, the first wall block 100 may be disposed in any desired orientation (horizontal or vertical).

At a step 420, one or more of the mechanical connectors 150 may be installed (engaged) in the grooves of the first wall block 100. For example, the cylinder-shaped peg members 158 of the mechanical connectors 150 are engaged with the wide grooves 136 and/or the open cores 128 of the first wall block 100 and/or the serrated leg members 154 of the mechanical connectors 150 are engaged with the narrow grooves 134 of the first wall block 100.

At a step 425, the next wall block 100 may be disposed in relation to the first wall block 100 and in any desired orientation (horizontal or vertical) while at the same time the mechanical connectors 150 of the first wall block 100 may be engaged within the grooves of next wall block 100. Namely, the cylinder-shaped peg members 158 of the mechanical connectors 150 may be engaged with the wide grooves 136 and/or the open cores 128 of the next wall block 100 and/or the serrated leg members 154 of the mechanical connectors 150 may be engaged with the narrow grooves 134 of the next wall block 100.

The presently disclosed wall blocks (e.g., the wall blocks 100, the top-half wall blocks 140, and the bottom-half wall blocks 145) provide a significant manufacturing improvement over prior art modular wall blocks and soil reinforcing systems. Namely, because the presently disclosed wall blocks may be oriented in either the vertical or horizontal directions, the equipment necessary to fabricate the presently disclosed wall blocks is minimized. Additionally, the shape and design of the presently disclosed wall blocks often provide for reduced materials and ease in manufacturability when compared to prior art modular wall blocks. Further, the shape and design of the presently disclosed wall blocks provide for significant weight reduction of the block as compared with prior art modular wall blocks. Finally, the assembly of the wall blocks to create the presently disclosed soil reinforcing system represents a significant improvement over prior art systems because of the simplicity in design, reduced number of distinct components, and ability to modify the components to the desired soil system configuration.

Referring now to FIG. 23 is a perspective view of another example of the presently disclosed wall block 500, wherein the wall block 500 can be used to form retaining walls and/or any other soil reinforcing structure. Further, FIG. 24 shows a front view, a top view, and two end views of the wall block 500 shown in FIG. 23.

The wall block 500 can be, for example, a concrete masonry block used for constructing retaining walls. Namely, the wall block 500 is an example of a modular wall block. The wall block 500 includes a front face 510, a rear face 512 that has a rear face tapered portion 514, a top face 516, and a bottom face 518. Accordingly, the wall block 500 has a flat end 520 and a tapered end 522. Optionally, the wall block 500 can have a hollow core 530 to reduce the weight and cost of the wall block 500. Further, the front face 510 of the wall block 500 can be textured to provide a certain appearance and/or aesthetic feature.

The wall block 100 has a length L, a height H, and a depth D. The length L of the wall block 100 can generally be from about 12 inches (30.48 cm) to about 24 inches (60.96 cm), and in one example is about 16 inches (40.64 cm). The height H of the wall block 100 can generally be from about 6 inches (15.24 cm) to about 12 inches (30.48 cm), and in one example is about 8 inches (20.32 cm). The depth D of the wall block 100 can generally be from about 5 inches (12.7 cm) to about 15 inches (38.1 cm), and in one example is about 9 inches (22.86 cm). The ratio of length L to height H is approximately 2:1 to allow for both horizontal alignment and vertical alignment with the same facing element (see FIG. 25 through FIG. 33).

In one example, the wall block 500 has a length L of about 18 inches (45.72 cm), a height H of about 9 inches (22.86 cm), and a depth D of about 9 inches (22.86 cm). In this example, the area of the front face 510 of the wall block 500 is about 1.125 sq ft (0.1 sq m), which is an increase as compared with conventional wall blocks that have a face area of about 1 sq ft (0.093 sq m). This means that fewer wall blocks 500 are needed for a given area as compared with using conventional wall blocks. Additionally, in this example, because of the hollow core 530 and the tapered end 522, the weight of the wall block 500 is about 60 lbs (27.2155 kg), which is a decrease as compared with conventional wall blocks that weigh about 75 lbs (34.0194 kg).

The wall block 500 can be used in combination with one or more connectors, such as mechanical connectors 540 (see FIG. 25 through FIG. 29), to connect one wall block 500 to another wall block 500 and/or to connect the wall block 500 to any other soil reinforcing elements. Accordingly, certain grooves are provided around the periphery of wall block 500; namely, around and behind the periphery of the front face 510. For example, a groove 524 is provided along the top face 516 and the flat end 520 of the wall block 500. The groove 524 has a certain width and depth. Further, a groove 526 is provided along the bottom face 518 and the tapered end 522 of the wall block 500. The groove 526 has a certain width and depth that is different than that of the groove 524. Namely, hereafter the groove 524 will be called the wide groove 524 and the groove 526 will be called the narrow groove 526. The wide groove 524 and the narrow groove 526 are designed to receive one or more mechanical connectors 540, wherein the wide groove 524 is sized to receive a wide member 542 (see FIG. 25) of the mechanical connectors 540 and the narrow groove 526 is sized to receive a narrow member 544 (see FIG. 25) of the mechanical connectors 540.

Referring now to FIG. 25 is a perspective view of an example of a soil reinforcing system 600 that includes an arrangement of the presently disclosed wall blocks 500, which can be used for concrete masonry elements. In soil reinforcing system 600, those wall blocks 500 that are aligned with their long axis horizontally are hereafter called horizontal wall blocks 500', while those wall blocks 500 that are aligned with their long axis vertically are hereafter called vertical wall blocks 500". Together, the horizontal wall blocks 500' and vertical wall blocks 500" can be used to provide variability to the wall appearance and aesthetic (see FIG. 25 through FIG. 29). A multitude of patterns may be arrived at to form the soil reinforcing system of the present invention through varying the horizontal and/or vertical alignments of the wall blocks 500 (see FIG. 30 through FIG. 33).

In this example, the soil reinforcing system 600 includes four horizontal wall blocks 500' and two vertical wall blocks 500" that are arranged as shown. The soil reinforcing system 600 may also include a first soil reinforcing element 550 that is integrated at a lower portion of the horizontal wall blocks 500' and vertical wall blocks 500" and a second soil reinforcing element 550 that maybe integrated at an upper portion of the horizontal wall blocks 500' and vertical wall blocks 500". In one example, the soil reinforcing elements 550 are geogrid structures. The soil reinforcing elements 550 may be, for example, a synthetic material, such as HDPE and polyester geogrids, or may be a steel reinforcing mesh, steel strips, or other soil reinforcing elements.

In the soil reinforcing system 600 of the present invention, multiple mechanical connectors 540 may be used to couple one wall block 500 to another and to couple the wall blocks 500 to the soil reinforcing elements 550. The mechanical connectors 540 are often mechanical block connectors and alignment devices. As discussed herein, each of the mechanical connectors 540 may have a wide member 542 that is designed to fit into wide groove 524 of the wall block 500 and a narrow member 544 that is designed to fit into narrow groove 526 of the wall block 500. FIG. 26 shows a close up front view of a portion of the soil reinforcing system 600 shown in FIG. 25, which shows the mechanical connectors 540 connecting the wall blocks 500 to the soil reinforcing element 550 (e.g., the geogrid).

Referring now to FIG. 27, FIG. 28, and FIG. 29 are views of the soil reinforcing system 600 formed using other arrangements of the presently disclosed wall blocks 500. For example, FIG. 27 shows a top view of the soil reinforcing system 600 wherein one vertical wall block 500" is arranged between two horizontal wall blocks 500'. The mechanical connectors 540 are also shown for connecting to adjacent elements (not shown). FIG. 28 shows a side view of the soil reinforcing system 600 wherein two horizontal wall blocks 500' are stacked in relation to one vertical wall block 500" and the soil reinforcing element 550 (e.g., the geogrid) is coupled to the uppermost horizontal wall block 500'. Again, the mechanical connectors 540 are shown for connecting the wall blocks 500 and the soil reinforcing element 550. FIG. 29 shows a side view of the soil reinforcing system 600 wherein the soil reinforcing element 550 (e.g., the geogrid) is arranged between two vertical wall blocks 500". Again, the mechanical connectors 540 are shown for connecting the vertical wall blocks 500" and the soil reinforcing element 550.

Referring again to FIG. 23 through FIG. 29, the wall blocks 500 may include the hollow core 530 for reducing the weight and cost of the wall blocks 500. Further, the rear face tapered portion 514 of the wall blocks 500 allows for the blocks to turn horizontal corners and radii. Additionally, the rear face tapered portion 514 of the wall blocks 500 allows for the block to be oriented with the long axis horizontally or vertically.

The wall blocks 500 may be stacked using varying horizontal and vertical alignments. The wall blocks 500 may be aligned using the mechanical connectors 540 that may also serve to attach soil reinforcing elements 550 to the wall blocks 500 whether in vertical (e.g., vertical wall blocks 500") or horizontal (e.g., horizontal wall blocks 500') alignment. FIG. 30, FIG. 31, FIG. 32, and FIG. 33 show front views of examples of various arrangements and patterns of the presently disclosed wall blocks 500. For example, FIG.

Figure 31:
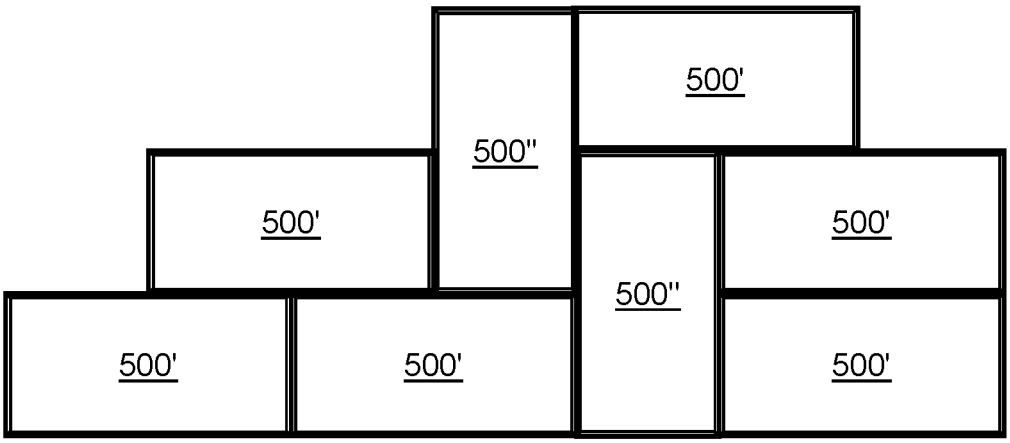

30 shows the "standard" running bond configuration. FIG. 31 shows "jumper" vertical blocks, which are the vertical wall blocks 500" laid on end among the horizontal wall blocks 500'. FIG. 32 shows one of many possible variations using the vertical orientation "jumper" blocks (e.g., vertical wall blocks 500") as part of the alignment. FIG. 33 shows one of several "pilaster" configurations that can be achieved using the vertical wall blocks 500" and the horizontal wall blocks 500'.

FIG. 34 and FIG. 35 illustrate various views of another example of the presently disclosed wall block 500. In this example, the wall block 500 includes two open cores 562 in addition to the hollow core 530. Namely, in this example, the narrow groove 526 (i.e., the connection slot) on the bottom face 518 of the wall block 500 is replaced by the two open cores 562. The open cores 562 are made of such dimensions and location so as to receive the upper end of the mechanical connectors 540. This may be a preferable method for manufacture in that the block may be produced without requiring certain equipment, such as a core puller. The open cores 562 extend through the full height of the wall block 500 from the top face 516 to the bottom face 518. There are generally two open cores 562; however, there may be more or less of the open cores 562 depending on the block dimensions and connection requirements.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments ±100%, in some embodiments ±50%, in some embodiments ±20%, in some embodiments ±10%, in some embodiments ±5%, in some embodiments ±1%, in some embodiments ±0.5%, and in some embodiments ±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

We claim:

1. A segmental wall block comprising:

(a) a front face;

(b) an asymmetrical rear face opposing the front face, the rear face having a tapered portion tapering on only one side in a length axis of the wall block and extending to the end of the rear face;

(c) a top face residing between the front face and the rear face;

(d) a bottom face opposing the top face and also residing between the front face and the rear face;

(e) a tapered end disposed adjacent to the tapered portion of the rear face;

(f) a flat end opposing the tapered end;

(g) a first groove disposed along the top face and the flat end; and (h) a second groove disposed along the bottom face and the tapered end.

2. The segmental wall block of claim 1, wherein the front face of the segmental wall block comprises an aesthetic feature disposed thereon.

3. The segmental wall block of claim 1 further comprising a hollow core extending from the top face through the bottom face.

4. The segmental wall block of claim 1 further comprising mechanical connectors.

5. The segmental wall block of claim 4, wherein a first mechanical connector is disposed within the first groove.

6. The segmental wall block of claim 5, wherein a second mechanical connector is disposed within the second groove.

7. The segmental wall block of claim 1, wherein the first groove comprises a first width and the second groove comprises a second width, the first width and second width are both measured from the front face to the rear face and are distinct.

8. The segmental wall block of claim 7, wherein the first width is greater than the second width.

9. The segmental wall block of claim 7 further comprising a mechanical connector, the mechanical connector comprising a first member having a first width and a second member having a second width, wherein the second width is distinct from the first width.

10. The segmental wall block of claim 9, wherein the first width of the first member corresponds to the first width of the first groove so that the first member of the mechanical connector is securable within the first groove of the segmental wall block.

11. The segmental wall block of claim 9, wherein the second width of the second member corresponds to the second width of the second groove so that the second member of the mechanical connector is securable within the second groove of the segmental wall block.

12. A soil reinforcing system comprising:

(a) a plurality of segmental wall blocks each comprising a front face, an asymmetrical rear face opposing the front face, a top face residing between the front face and the rear face, the rear face having a tapered portion tapering on only one side in a length axis of the wall block and extending to the end of the rear face, a bottom face opposing the top face and also residing between the front face and the rear face, a first end disposed adjacent to the rear face; a second end opposing the first end; a first groove disposed along the top face and the second end; and a second groove disposed along the bottom face and the first end; and (b) a plurality of connectors that secure the plurality of segmental wall blocks together, each connector secured within the first groove or the second groove of each of the segmental wall blocks.

13. The system of claim 12, wherein the front face of the first segmental wall block comprises an aesthetic feature disposed thereon.

14. The system of claim 12, wherein the second end is flat.

15. The system of claim 12 further comprising a soil reinforcing element for reinforcement of the wall blocks in a soil mass.

16. The system of claim 15, wherein the soil reinforcing element is a geogrid.

17. The system of claim 15, wherein the plurality of connectors further secure the soil reinforcing element to at least one of the plurality of segmental wall blocks.

18. The system of claim 12, wherein the front face of each of the segmental wall blocks comprises a height and a length, the height being a distance less than the length.

19. The system of claim 18, wherein the plurality of segmental wall blocks of the soil reinforcing system are arranged in a standard running configuration.

20. The system of claim 18, wherein the plurality of segmental wall blocks of the soil reinforcing system are arranged in a pilaster configuration.

21. The system of claim 18, wherein a configuration of the plurality of segmental wall blocks of the soil reinforcing system includes vertically oriented blocks.

22. The system of claim 21, wherein the configuration includes vertically oriented blocks in combination with horizontally oriented blocks.

23. The system of claim 12, wherein the first groove comprises a first width and the second groove comprises a second width, the first width and second width are both measured from the front face to the rear face and are distinct.

24. The system of claim 23, wherein the plurality of connectors each comprise a first member and a second member, the first member of a connector sized to secure within the first groove of a first segmental block and the second member of the connector sized to secure within the second groove of an adjacent segmental block.

25. A method of reinforcing soil comprising the steps of:

(a) providing a plurality of wall blocks, each wall block comprising a front face, an asymmetrical rear face opposing the front face, the rear face having a tapered portion tapering on only one side in a length axis of the wall block and extending to the end of the rear face, a top face residing between the front face and the rear face, a bottom face opposing the top face and also residing between the front face and the rear face, a first end disposed adjacent to the rear face; a second end opposing the first end; a first groove disposed along the top face and the second end; and a second groove disposed along the bottom face and the first end;

(b) orienting a first wall block of the plurality of wall blocks in a desired orientation;

(c) providing a connector having a first member and a second member;

(d) engaging the first member of the connector in the first or second groove of the first wall block;

(e) orienting a second wall block of the plurality of wall blocks in a desired orientation adjacent to the first wall block; and (f) engaging the second member of the connector in a first or second groove of the second wall block.

26. The method of claim 25, further comprising the steps of:

(a) providing a plurality of connectors each having a first member and a second member;

(b) engaging the first member of multiple connectors of the plurality of connectors in the first or second groove of the first wall block; and (c) engaging the second member of multiple connectors of the plurality of connectors in the first or second groove of the second wall block.

27. The method of claim 25, wherein the first groove comprises a first width and the second groove comprises a second width, the first width and second width are both measured from the front face to the rear face and are distinct.

* * * * *